US006414428B1

(12) United States Patent
Schropp, Jr. et al.

(10) Patent No.: US 6,414,428 B1
(45) Date of Patent: Jul. 2, 2002

(54) FLAT-PANEL DISPLAY WITH INTENSITY CONTROL TO REDUCE LIGHT-CENTROID SHIFTING

(75) Inventors: Donald R. Schropp, Jr., San Jose; John E. Field, Dorrington; James C. Dunphy, San Jose; Lawrence S. Pan, Los Gatos; David L. Morris, San Jose; Ronald S. Besser, Sunnyvale; Christopher J. Spindt, Menlo Park, all of CA (US)

(73) Assignees: Candescent Technologies Corporation; Candescent Intellectual Property Services, Inc., both of San Jose, CA (US)

( * ) Notice: Subject to any disclaimer, the term of this patent is extended or adjusted under 35 U.S.C. 154(b) by 0 days.

(21) Appl. No.: 09/302,698

(22) Filed: Apr. 30, 1999

Related U.S. Application Data

(63) Continuation-in-part of application No. 09/111,386, filed on Jul. 7, 1998, now abandoned.

(51) Int. Cl.[7] ..... H01J 1/62
(52) U.S. Cl. ..... 313/495; 313/292; 313/422
(58) Field of Search ..... 313/495, 292, 313/422, 496, 497, 309, 336, 351

(56) References Cited

U.S. PATENT DOCUMENTS

| | | | | |
|---|---|---|---|---|
| 3,935,499 | A | 1/1976 | Oess | 313/413 |
| 4,174,523 | A | 11/1979 | Marlowe et al. | 358/67 |
| 4,769,575 | A | 9/1988 | Murata et al. | 313/495 |
| 5,130,614 | A | 7/1992 | Staelin | 315/366 |
| 5,229,691 | A | 7/1993 | Shichao et al. | 315/366 |
| 5,313,136 | A | 5/1994 | Van Gorkom et al. | 313/422 |
| 5,374,868 | A | 12/1994 | Tjaden et al. | 313/310 |
| 5,514,847 | A | 5/1996 | Makishima et al. | 219/121.12 |
| 5,528,103 | A | 6/1996 | Spindt et al. | 313/497 |
| 5,532,548 | A | 7/1996 | Spindt et al. | 313/422 |
| 5,569,975 | A | 10/1996 | Taylor et al. | 313/310 |
| 5,574,333 | A | 11/1996 | Clerc | 313/497 |
| 5,578,899 | A | 11/1996 | Haven et al. | 313/422 |
| 5,589,731 | A | 12/1996 | Fahlen et al. | 313/495 |
| 5,614,781 | A | 3/1997 | Spindt et al. | 313/422 |
| 5,631,518 | A | 5/1997 | Barker | 313/308 |
| 5,650,690 | A | 7/1997 | Haven | 313/422 |
| 5,667,418 | A | 9/1997 | Fahlen et al. | 445/25 |
| 5,675,212 | A | 10/1997 | Schmid et al. | 313/422 |
| 5,686,782 | A | 11/1997 | Hacker, Jr. et al. | 313/309 |
| 5,828,163 | A | 10/1998 | Jones et al. | 313/336 |
| 5,920,151 | A | 7/1999 | Barton et al. | 33/309 |
| 5,998,923 | A | 12/1999 | Jäger | 313/495 |
| 6,184,619 | B1 * | 2/2001 | Yamazaki et al. | 313/495 |

FOREIGN PATENT DOCUMENTS

EP 0 436 997 A1 7/1991

OTHER PUBLICATIONS

Takahashi et al, "Back Modulation Type Flat CRT," Japanese Display '92 , 1992, pp. 377–380.

* cited by examiner

*Primary Examiner*—Vip Patel
*Assistant Examiner*—Ken A Berck
(74) *Attorney, Agent, or Firm*—Skjerven Morrill LLP; Ronald J. Meetin

(57) ABSTRACT

The intensity at which electrons emitted by a first plate structure (10) in a flat-panel display strike a second plate structure (12) for causing it to emit light is controlled so as to reduce image degradation that could otherwise arise from undesired electron-trajectory changes caused by effects such as the presence of a spacer system (14) between the plate structures. An electron-emissive region (20) in the first plate structure typically contains multiple laterally separated electron-emissive portions ($\mathbf{20}_1$ and $\mathbf{20}_2$) for selectively emitting electrons. An electron-focusing system in the first plate structure has corresponding focus openings ($\mathbf{42P}_1$ and $\mathbf{42P}_2$) through which electrons emitted by the electron-emissive portions respectively pass. Upon being struck by the so-emitted electrons, a light-emissive region (22) in the second plate structure emits light to produce at least part of a dot of the display's image.

92 Claims, 7 Drawing Sheets

FLAT-PANEL DISPLAY WITH INTENSITY CONTROL TO REDUCE LIGHT-CENTROID SHIFTING

CROSS-REFERENCE TO RELATED APPLICATION

This is a continuation-in-part of U.S. patent application Ser. No. 09/111,386, filed Jul. 7, 1998 now abandoned, the contents of which are incorporated by reference to the extent not repeated herein.

FIELD OF USE

This invention relates to flat-panel displays of the cathode-ray-tube ("CRT") type.

BACKGROUND

A flat-panel CRT display basically consists of an electron-emitting device and a light-emitting device. The electron-emitting device, commonly referred to as a cathode, contains electron-emissive regions that emit electrons over a relatively wide area. The emitted electrons are appropriately directed towards light-emissive elements distributed over a corresponding area in the light-emitting device. Upon being struck by the electrons, the light-emissive elements emit light that produces an image on the display's viewing surface.

The electron-emitting and light-emitting devices are connected together to form a sealed enclosure maintained at a pressure much less than 1 atm. The exterior-to-interior pressure differential across the display is typically close to 1 atm. In a flat-panel CRT display of significant viewing area, e.g., at least 10 $cm^2$, the electron-emitting and light-emitting devices are normally incapable of resisting the exterior-to-interior pressure differential on their own. Accordingly, a spacer (or support) system is conventionally provided inside the sealed enclosure to prevent air pressure and other external forces from collapsing the display.

The spacer system typically consists of a group of laterally separated spacers positioned so as to not be directly visible on the viewing surface. The presence of the spacer system can adversely affect the flow of electrons through the display. For example, electrons can occasionally strike the spacer system, causing it to become electrically charged. The electric potential field in the vicinity of the spacer system changes. The electron trajectories are thereby affected, commonly leading to degradation in the image produced on the viewing surface.

Numerous techniques have been investigated for making a spacer system electrically invisible to the electron flow. For example, see U.S. Pat. Nos. 5,532,548 and 5,675,212. Although many of these techniques significantly reduce image degradation caused by a spacer system, some image degradation can still occur as the result of electron deflections caused by the spacer system. Making a spacer system completely electrically invisible to the electron flow is extremely difficult. Accordingly, it is desirable to have a technique for reducing image degradation despite undesired electron-trajectory changes caused by a spacer system.

GENERAL DISCLOSURE OF THE INVENTION

In accordance with the invention, the intensity at which electrons emitted by a first plate structure in a flat-panel display strike an oppositely situated second plate structure in the display for causing the second plate structure to emit light is controlled in a manner to reduce image degradation that could otherwise arise from undesired electron-trajectory changes caused by effects such as the presence of a spacer system between the plate structures. The first plate structure contains an electron-emissive region for emitting electrons. The second plate structure contains a light-emissive element for emitting light upon being struck by electrons.

Electrons emitted from the electron-emissive region strike the light-emissive element with an intensity having an electron-striking centroid along the second plate structure. The resultant light is emitted by the light-emissive element with an intensity having a light-emitting centroid along the second plate structure. The light-emitting centroid is shifted in a primary direction due to shifting of the electron-striking centroid in the primary direction. The shifting of the electron-striking centroid in the primary direction occurs because electrons are generally deflected in the primary direction, typically due to the presence of the spacer system. Deflection of electrons in the primary direction and the resultant shift of the electron-striking centroid in the primary direction can also arise from various errors in fabricating the display.

A useful parameter for characterizing centroid shifting in the primary direction is primary centroid shift ratio $R_P$ defined as (a) the amount of shift of the light-emitting centroid in the primary direction divided by (b) the amount of shift of the electron-striking centroid in the primary direction. In one aspect of the invention, primary centroid shift ratio $R_P$ is no more than 0.5 when the magnitude of shift of the electron-striking centroid in the primary direction is in a suitable range. By having shift ratio $R_P$ be this low, the shift of the light-emitting centroid in the primary direction is only a fraction, typically a small fraction, of the shift of the electron-striking centroid in the primary direction. Any such shift of the electron-striking centroid arising from electron deflections caused, for example, by the spacer system is therefore significantly inhibited from causing a shift in the light-emitting centroid and producing image degradation.

When centroid shifting can occur in a further direction different from, typically perpendicular to, the primary direction, another useful parameter is relative centroid shift ratio $R_P/R_F$ for centroid shifting in the primary direction relative to centroid shifting in the further direction. Item $R_P$ is the primary centroid shift ratio dealt with above. Item $R_F$, the further centroid shift ratio, is (a) the amount that the light-emitting centroid is shiftable in the further direction divided by (b) the amount that the electron-striking centroid is shiftable in the further direction. In another aspect of the invention, relative centroid shift ratio $R_P/R_F$ is no more than 0.75 when the magnitudes of shift of the electron-striking centroid in the primary and further directions are in suitable ranges.

Arranging for relative centroid shift ratio $R_P/R_F$ to satisfy the foregoing criteria takes advantage of the fact that the average magnitude of electron deflections is normally considerably greater in the primary direction than in the further direction. In particular, the presence of the spacer system typically does not cause the electron-striking centroid to shift significantly in the further direction. Consequently, electron deflections which occur do not lead to significant image degradation. With primary centroid shift ratio $R_P$ being no more than 0.5 under the indicated conditions and with further centroid shift ratio $R_F$ being relatively high under the indicated conditions so that relative centroid shift ratio $R_P/R_F$ is no more than 0.75 under the indicated conditions, the flat-panel display operates quite efficiently in the further direction in producing light as the result of electrons striking the second plate structure.

In a further aspect of the invention, the intensity of electrons striking the light-emissive element along an imaginary plane extending in the primary direction through the center of the light-emissive element generally perpendicular to the second plate structure has a 10% moving average intensity profile having a local minimum. A 10% moving intensity average in a particular direction across the light-emissive element means that the intensity employed to characterize a particular point of the light-emissive element is the average intensity along a line centered on that point and of a length equal to 10% of the mean dimension of the light-emissive element in the particular direction. Use of a 10% moving average smoothes out large local intensity variations, including those resulting from measurement errors, in the actual electron-striking intensity so as to produce a highly characteristic representation of the electron-striking intensity.

The intensity value at the local minimum in the 10% moving average profile for the electron-striking intensity is normally no more than 95%, typically no more than 90%, of the maximum intensity value in the 10% moving average profile. By having such a local minimum in the 10% moving average intensity profile, primary centroid shift $R_P$ is no more than 0.5 when the magnitude of shift of the electron-striking centroid in the primary direction is in a suitable range. Similarly, relative centroid shift ratio $R_P/R_F$ is normally no more than 0.75 when the magnitudes of shift of the electron-striking centroid in the primary and further directions are in suitable ranges. Any such shift of the electron-striking centroid arising from electron deflections caused, for example, by the spacer system is therefore significantly inhibited from causing a shift in the light-emitting centroid and producing image degradation.

The present flat-panel display typically contains a two-dimensional array of electron-emissive regions and a like-arranged two-dimensional array of light-emissive elements. As a result, intensity averaging across multiple light-emissive elements can be substituted for a moving intensity average across one light-emissive element. Using this alternative averaging approach, the intensities of electrons striking the light-emissive elements along imaginary planes extending in a primary direction through the centers of the light-emissive elements have a composite average intensity profile which has a local minimum. Similar to the local minimum in the 10% moving average electron-striking intensity profile, the local minimum in the composite average electron-striking intensity profile for multiple light-emissive elements leads to significant reduction in the amount of average shift of the light-emitting centroids, thereby substantially reducing image degradation.

In yet another aspect of the invention, an electron-emissive region of a flat-panel display contains a plurality of laterally separated electron-emissive portions which selectively emit electrons. The display includes a system for focusing electrons emitted by the electron-emissive portions. The electron focusing system has a corresponding plurality of focus openings located respectively above the electron-emissive portions. The electrons emitted by the electron-emissive portions respectively pass through the focus openings.

A light-emissive element, which is situated opposite the electron-emissive region and therefore opposite all of its electron-emissive portions, emits light to produce at least part of a dot of the display's image upon being struck by electrons emitted from the electron-emissive portions. By utilizing electrons that pass through plural focus openings to produce at least part of an image dot in this manner, the display can readily achieve the above-mentioned intensity characteristics. The display's image is much improved. The invention thereby provides a substantial advance.

BRIEF DESCRIPTION OF THE DRAWINGS

Like reference symbols are employed in the drawings and in the description of the preferred embodiments to represent the same, or very similar, item or items.

DESCRIPTION OF THE PREFERRED EMBODIMENTS

The present invention furnishes a flat-panel CRT display in which the intensity at which electrons strike a faceplate structure in the display after being emitted by a backplate structure in the display is controlled so as to reduce image degradation that could otherwise result from undesired electron-trajectory changes caused by effects such as the presence of a spacer system in the display. Electron emission in the present flat-panel CRT display typically occurs according to field-emission principles.

In the following description, the term "electrically insulating" (or "dielectric") generally applies to materials having a resistivity greater than $10^{10}$ ohm-cm. The term "electrically non-insulating" thus refers to materials having a resistivity of no more than $10^{10}$ ohm-cm. Electrically non-insulating materials are divided into (a) electrically conductive materials for which the resistivity is less than 1 ohm-cm and (b) electrically resistive materials for which the resistivity is in the range of 1 ohm-cm to $10^{10}$ ohm-cm. Similarly, the term "electrically non-conductive" refers to materials having a resistivity of at least 1 ohm-cm, and includes electrically resistive and electrically insulating materials. These categories are determined at an electric field of no more than 10 volts/$\mu$m.

For a generally flat substantially non-perforated item of roughly constant thickness, the mean dimension of the item in a particular lateral direction perpendicular to the item's thickness is the length or width of a rectangle (including a square) which occupies the same lateral area as the item and which most closely matches the shape of the item with the length or width of the rectangle extending in the particular direction. The item's mean dimension is the rectangle's length when the item is of greater dimension in the particular direction than perpendicular thereto. Similarly, the item's mean dimension is the rectangle's width when the items is of lesser dimension in the particular direction than perpendicular thereto.

Figure 1:
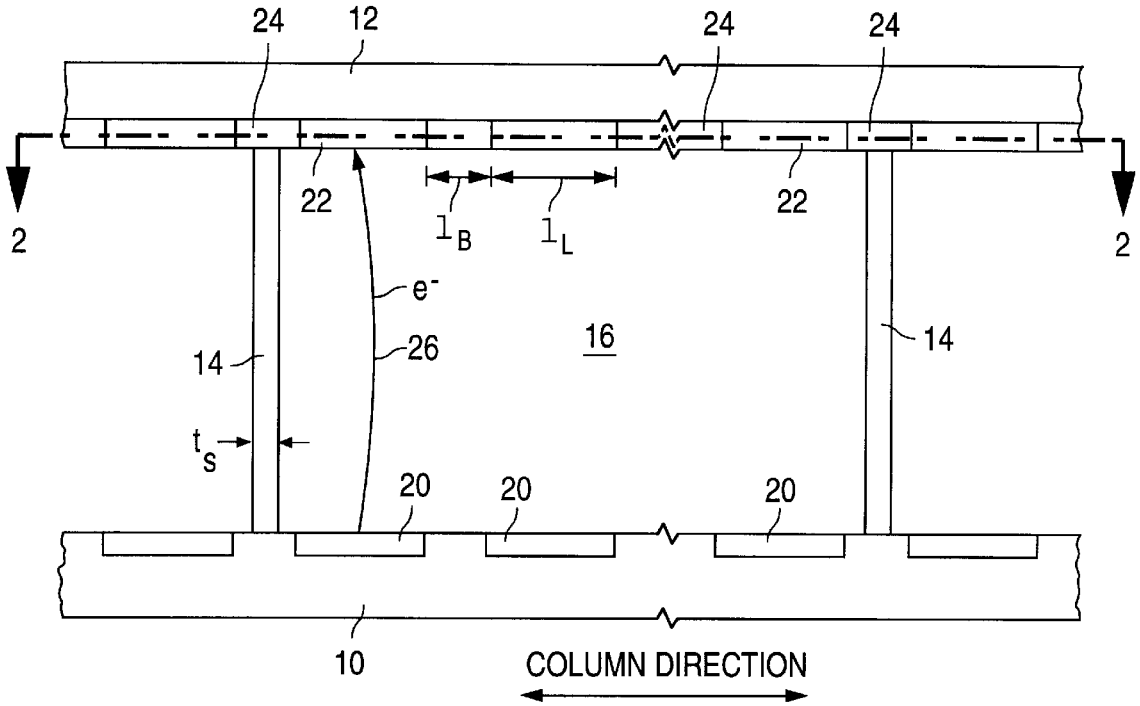
FIG. 1 is a schematic cross-sectional side view of part of a flat-panel CRT display having a faceplate structure that emits light to produce an image in response to electrons striking the faceplate structure with an intensity distribution that can be controlled according to the invention.

FIG. 1 illustrates a field-emission flat-panel CRT display (often referred to as a field-emission display) whose electron-striking intensity can be controlled according to the invention. The field-emission display ("FED") of FIG. 1 contains an electron-emitting backplate structure 10, a light-emitting faceplate structure 12, and a spacer system situated between plate structures 10 and 12 for resisting external forces exerted on the display and for maintaining a largely constant spacing between plate structures 10 and 12. In the FED of FIG. 1, the spacer system consists of laterally separated spacers 14 generally shaped as relatively flat walls. Each spacer wall 14 extends generally perpendicular to the plane of FIG. 1. Plate structures 10 and 12 are connected together through an annular outer wall (not shown) to form a high-vacuum sealed enclosure 16 in which spacer walls 14 are situated.

Backplate structure 10 contains a two-dimensional array of rows and columns of largely identical laterally separated electron-emissive regions 20 that face enclosure 16. Electron-emissive regions 20 overlie an electrically insulating backplate (not separately shown) of plate structure 10. Each electron-emissive region 20 normally consists of a large number of electron-emissive elements shaped in various ways such as cones, filaments, or randomly shaped particles. Plate structure 10 also includes a system (also not separately shown) for focusing electrons emitted by regions 20.

The column direction extends horizontally in FIG. 1, parallel to the plane of the figure. FIG. 1 thus illustrates a column of electron-emissive regions 20. The row direction extends into the plane of FIG. 1. In the orientation of pig. 1, spacer walls 14 extend laterally in the row direction. Each spacer wall 14 contacts backplate structure 10 between a pair of rows of regions 20 as viewed generally perpendicular to (the exterior surface of) backplate structure 10. Each consecutive pair of walls 14 is separated by multiple rows of regions 20.

Faceplate structure 12 contains a two-dimensional array of rows and columns of largely identical laterally separated light-emissive elements 22 formed with light-emissive material such as phosphor. Light-emissive elements 22 overlie a transparent electrically insulating faceplate (not separately shown) of plate structure 12. Each electron-emissive element 22 is situated directly opposite a corresponding one of electron-emissive regions 20. Accordingly, each spacer wall 14 contacts faceplate structure 12 between a pair of elements 22 as viewed generally perpendicular to (the exterior surface of) faceplate structure 12. The light emitted by elements 22 forms a desired, typically time-variable, image on the display's viewing surface at the exterior surface of faceplate structure 12.

The FED of FIG. 1 may be a black-and-white or color display. Each light-emissive element 22 and corresponding electron-emissive region 20 form a pixel in the black-and-white case, and a sub-pixel in the color case. A color pixel typically consists of three sub-pixels, one for red, another for green, and a third for blue. Each pixel provides a dot of the display's image. Consequently, the light emitted by each element 22 produces a dot of the image in a black-and-white implementation, or part of an image dot in a color implementation.

A border region 24 of dark, typically black material laterally surrounds each of light-emissive regions 22 above the faceplate. Border region 24 is referred to as a black matrix. Compared to light-emissive elements 22, black matrix 24 is substantially non-emissive of light when struck by electrons emitted from regions 20 in backplate structure 10. Faceplate structure 12 has an active area consisting of the lateral area occupied by light-emissive regions 22 and black matrix 24.

In addition to components 22 and 24, faceplate structure 12 contains an anode (not separately shown) situated over or under components 22 and 24. During display operation, the anode is furnished with a potential that attracts electrons to light-emissive elements 22.

Figure 2:
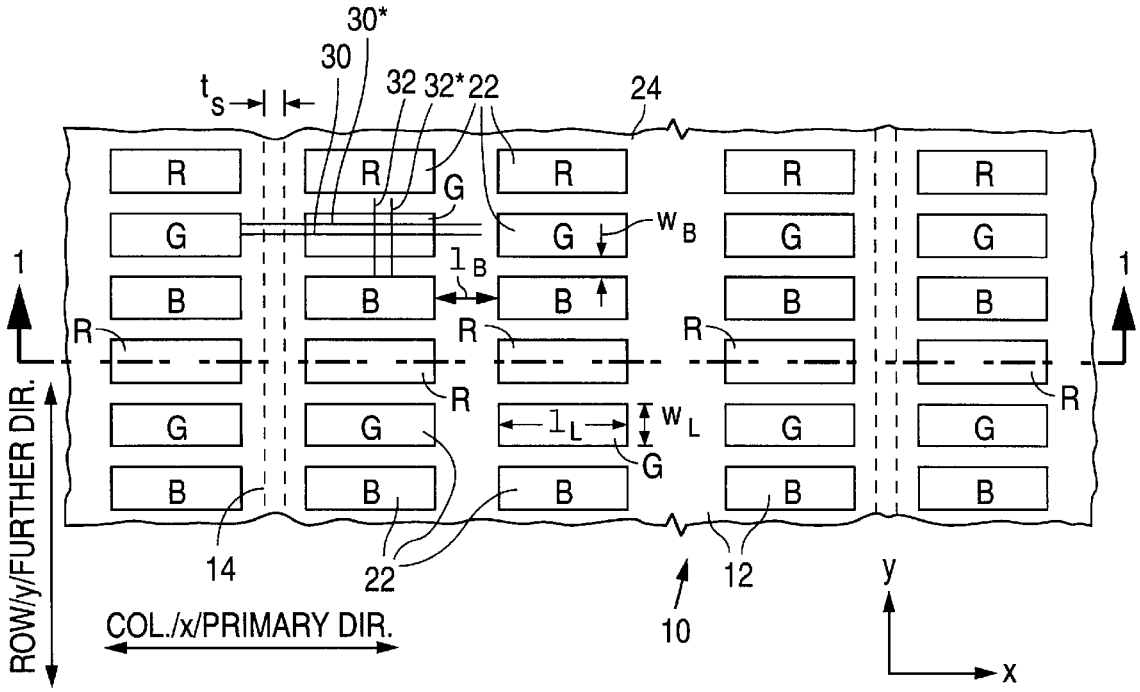
FIG. 2 is a cross-sectional layout view of an embodiment of the portion of the faceplate structure in the flat-panel display of FIG. 1. The cross section of FIG. 2 is taken through plane 2—2 in FIG. 1. The cross section of FIG. 1 is taken through plane 1—1 in FIG. 2.

FIG. 2 depicts an exemplary layout of light-emissive elements 22 across faceplate structure 12 for a color implementation of the FED. The letters "R", "G", and "B" in FIG. 2 indicate elements 22 that respectively emit red, green, and blue light. In FIG. 2, the column direction extends horizontally, the row direction therefore extending vertically. All of elements 22 in a column emit light of the same color. Each color pixel, typically square, contains three consecutive elements 22 in a row of elements 22.

Each light-emissive element 22 is of length $l_L$ in the column direction and of width $w_L$ in the row direction, element length $l_L$ being greater than element width $w_L$. Each consecutive pair of elements 22 in the column direction are separated by a black-matrix row strip of dimension $l_B$ in the column direction. In the row direction, each consecutive pair of elements 22 are separated by a black-matrix column strip of dimension $w_B$ in the row direction. Each of spacer walls 14 is of approximate thickness $t_S$ in the column direction. Each spacer wall 14 is situated over the middle of a black-matrix row strip so as to be approximately equidistant from the two nearest rows of elements 22.

During display operation, electron-emissive regions 20 are controlled to emit electrons that selectively move toward faceplate structure 12. The electrons so emitted by each region 20 preferably strike corresponding light-emissive element 22, causing it to emit light. Item 26 in FIG. 1 illustrates the trajectory of a typical electron traveling from one of regions 20 to corresponding element 22. Some electrons invariably strike other parts of the display, such as black matrix 24.

Electrons which impinge on faceplate structure 12 after being emitted from a particular region 20 strike plate structure 12 with an electron-striking intensity (or local current density) $I_E$ that varies with the lateral position of the electron-striking location. The units of electron-striking intensity $I_E$ are current units per unit area, e.g., amps./m$^2$. The layout of FIG. 2 is illustrated with respect to an xy coordinate system for which the x and y coordinates respectively extend in the column and row directions. Electron-striking intensity $I_E$ is a function of x and y. For electrons emitted by each particular region 20, electron-striking intensity $I_E(x,y)$ has a centroid whose positions $x_E$ and $y_E$ along the x and y axes are given as:

$$x_E = \frac{\iint_{A_A} x I_E(x, y)\,dx\,dy}{\iint_{A_A} I_E(x, y)\,dx\,dy} \tag{1}$$

$$y_E = \frac{\iint_{A_A} y I_E(x, y)\,dx\,dy}{\iint_{A_A} I_E(x, y)\,dx\,dy} \tag{2}$$

where $A_A$ is the active area of faceplate structure 12.

Upon being struck by electrons emitted from a particular region 20, corresponding element 22 emits light with a light-emitting intensity $I_L$ that likewise is a function of x and y. The units of light-emitting intensity $I_L$ are light units per unit area, e.g., lumens/m$^2$. For each light-emissive element 22, light-emitting intensity $I_L(x,y)$ has a centroid whose positions $x_L$ and $y_L$ along the x and y axes are given as:

$$x_L = \frac{\iint_{A_L} x I_L(x, y)\,dx\,dy}{\iint_{A_L} I_L(x, y)\,dx\,dy} \tag{3}$$

$$y_L = \frac{\iint_{A_L} y I_L(x, y)\,dx\,dy}{\iint_{A_L} I_L(x, y)\,dx\,dy} \tag{4}$$

where $A_L$ is the lateral area of that light-emissive element 22. Referring to FIG. 2, element area $A_L$ equals $l_L w_L$.

When electron-striking intensity $I_E$ is relatively low (in magnitude), light-emitting intensity $I_L$ is approximately proportional to electron-striking intensity $I_E$ across area $A_L$ of each light-emissive element 22. At low electron-striking intensity $I_E$, Eqs. 3 and 4 can therefore be modified to:

$$x_L \approx \frac{\iint_{A_L} x I_E(x, y)\,dx\,dy}{\iint_{A_L} I_E(x, y)\,dx\,dy} \tag{5}$$

$$y_L \approx \frac{\iint_{A_L} y I_E(x, y)\,dx\,dy}{\iint_{A_L} I_E(x, y)\,dx\,dy} \tag{6}$$

Saturation of each light-emissive element 22 occurs when electron-striking intensity $I_E$ becomes high. Light-emitting intensity $I_L$ increases more slowly than electron-striking intensity $I_E$ as light-emission saturation is approached. Although Eqs. 5 and 6 may not be good approximations when electron-striking intensity $I_E$ is high, the principles of the invention do apply at high values of intensity $I_E$.

The electric potential field along spacer walls 14 typically differs from the electric potential field that would otherwise exist at the same locations in free space between plate structures 10 and 12, i.e., in the absence of walls 14. Consequently, walls 14 affect the movement of electrons from backplate structure 10 to faceplate structure 12. Depending on how walls 14 are configured, electrons can be deflected toward, or away from, nearest walls 14. The magnitudes of the wall-caused electron deflections are normally greater for electrons emitted from regions 20 closest to walls 14. Depending on the magnitudes and directions of the wall-caused deflections, the presence of walls 14 can cause some electrons to strike black matrix 24 and even walls 14 themselves. Electron deflections can also arise from various types of display fabrication errors such as misalignment of plate structures 10 and 12, misalignment of the electron-focusing system, and even misalignment of walls 14 themselves.

The primary effect of electron deflections caused by the spacer system or/and such display fabrication errors is readily assessable in terms of the resulting shifts in the electron-striking centroid positions $x_E$ and $y_E$ and the light-emitting centroid positions $x_L$ and $y_L$ at each light-emissive element 20. Let $x_{EU}$, $y_{EU}$, $x_{LU}$, and $y_{LU}$ respectively represent the values of centroid positions $x_E$, $y_E$, $x_L$, $y_L$ for the situation in which there is no shift in the $I_E$ centroid and thus no shift in the $I_L$ centroid. Similarly, let $x_{ES}$, $y_{ES}$, $x_{LS}$, and $y_{LS}$ respectively represent the values of centroid positions $x_E$, $y_E$, $x_L$, and $y_L$ when a shift occurs in the $I_E$ centroid and thus in the $I_L$ centroid. The shifts $\Delta x_E$, $\Delta y_E$, $\Delta x_L$, and $\Delta y_L$ in centroid positions $x_E$, $y_E$, $x_L$, and $y_L$ are respectively given as:

$$\Delta x_E = x_{ES} - x_{EU} \tag{7}$$

$$\Delta y_E = y_{ES} - y_{EU} \tag{8}$$

$$\Delta x_L = x_{LS} - x_{LU} \tag{9}$$

$$\Delta y_L = y_{LS} - y_{LU} \tag{10}$$

For purposes of generality, let the column (x) and row (y) directions respectively be termed the primary and further directions. An important parameter is the ratio $R_P$ of light-emitting centroid shift $\Delta X_L$ to electron-striking centroid shift $\Delta x_E$ for shifting in the primary (x) direction. Another important parameter is the ratio $R_F$ of light-emitting centroid shift $\Delta y_L$ to electron-striking centroid shift $\Delta y_E$ for shifting in the further (y) direction. Primary centroid shift ratio $R_P$ and further centroid shift $R_F$ ratio are given as:

$$R_P = \frac{\Delta x_L}{\Delta x_E} = \frac{x_{LS} - x_{LU}}{x_{ES} - x_{EU}} \tag{11}$$

$$R_F = \frac{\Delta y_L}{\Delta y_E} = \frac{y_{LS} - y_{LU}}{y_{ES} - y_{EU}} \tag{12}$$

where shifted centroid positions $x_{ES}$, $x_{LS}$, $y_{ES}$, and $y_{LS}$, and unshifted centroid position $x_{EU}$, $x_{LU}$, $y_{EU}$, and $y_{LU}$ are determined from Eqs. 1 and 2 and either Eqs. 3 and 4 or, for low electron-striking intensity $I_E$, Eqs. 5 and 6. Shift ratios $R_P$ and $R_F$ may, and typically do, vary respectively with electron-striking centroid shifts $\Delta x_E$ and $\Delta y_E$, and thus also respectively with light-emitting centroid shifts $\Delta x_L$ and $\Delta y_L$.

Consider a baseline color FED arranged generally as shown in FIG. 1, having light-emissive elements 22 configured in generally rectangular shapes as depicted in FIG. 2, and having electron-emissive regions 20 configured laterally in corresponding generally rectangular shapes of relatively uniform electron-emission density. Analysis of the baseline FED indicates that faceplate structure 12 has roughly bell-shaped intensity profiles as generally shown in FIGS. 3*a*, 3*b*, 4*a*, and 4*b*. The intensity in each of FIGS. 3*a*, 3*b*, 4*a*, and 4*b* is specifically electron-striking intensity $I_E$. Within a region corresponding to a light-emissive element 22, the intensity in FIGS. 3*a*, 3*b*, 4*a*, and 4*b* also generally represents light-emitting intensity $I_L$ at low electron-striking intensity $I_E$.

Figure 3A:
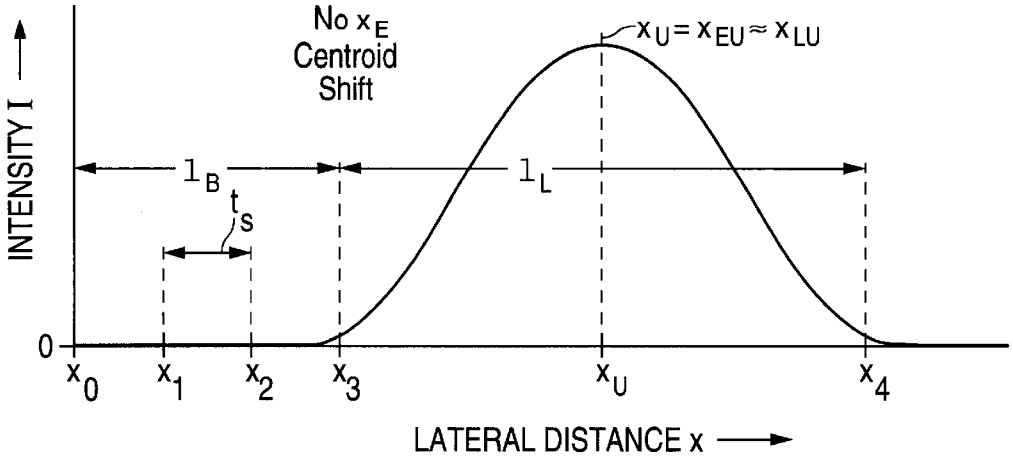
FIGS. 3*a* and 3*b* are bell-shaped profiles of intensity along part of a faceplate structure of a baseline flat-panel CRT display as a function of lateral distance perpendicular to the walls of a spacer system in the display for the respective situations of zero and non-zero intensity-centroid shift.
Figure 3B:
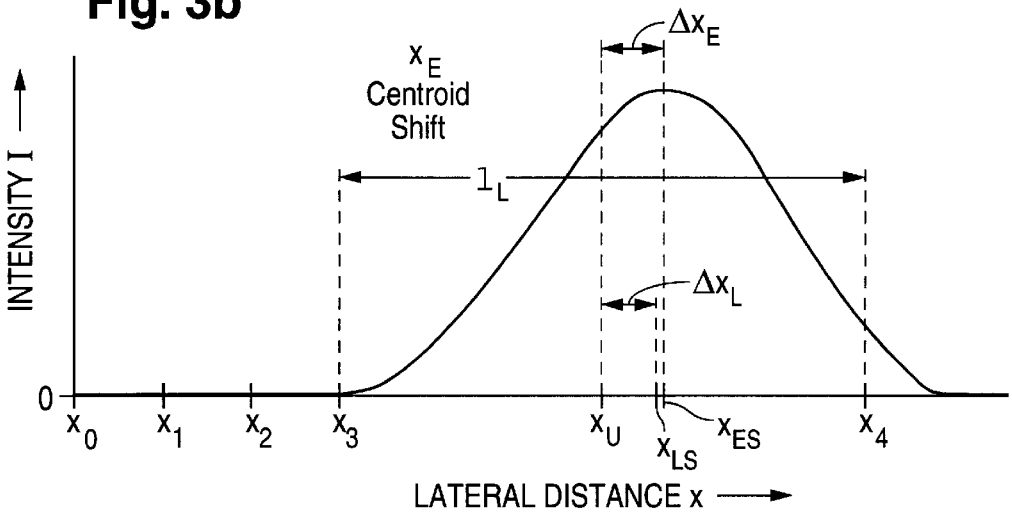

FIGS. 3*a* and 3*b* illustrate how electron-striking intensity $I_E$ varies with coordinate x along suitable locations extending in the x (primary) direction through a light-emissive element 22 closest to a spacer wall 14 in the baseline FED. This element 22 is referred to here as wall-adjacent element 22. With reference to the orientation used in FIG. 2, items $x_3$ and $x_4$ in FIGS. 3*a* and 3*b* respectively are the x positions of the left-hand and right-hand edges of wall-adjacent element 22. Items $x_1$ and $x_2$ are the x positions of the left-hand and right-hand sides of spacer wall 14 closest to wall-adjacent element 22. Item $x_0$ is the x position of the right-hand edge of the nearest light-emissive element 22 on the opposite side of that wall 14.

FIG. 3*a* represents the situation in which there is no shift in electron-striking centroid position $x_E$. FIG. 3*b* represents the situation in which the presence of spacer walls 14 causes centroid position $x_E$ to shift. FIGS. 1*a* and 2*b* are taken along locations that pass through the points where electron-striking intensity $I_E$ reaches its maximum magnitude in wall-adjacent light-emissive element 22. For the situation of no shift in centroid positions $x_E$ and $y_E$, the maximum $I_E$ magnitude typically occurs approximately at the center (centroid by area) of wall-adjacent element 22. Accordingly, FIG. 3*a* depicts the variation of intensity $I_E$ along an imaginary plane 30 extending in the x direction through the center of wall-adjacent element 22 in FIG. 2 generally parallel to (the exterior surface of) faceplate structure 12.

When an $x_E$ centroid shift occurs, the location of the maximum $I_E$ magnitude is shifted in the x direction, typically by an amount approximately equal to electron-striking centroid shift $\Delta x_E$. If a simultaneous shift in centroid position $y_E$ occurs, the location of the maximum $I_E$ magnitude is also shifted in the y direction by an amount typically approximately equal to electron-striking centroid shift $\Delta y_E$. For this reason, FIG. 3*b* depicts the variation of intensity $I_E$ along another imaginary plane 30* that extends in the x direction through wall-adjacent element 22 in FIG. 2 generally perpendicular to faceplate structure 12. Plane 30* is shifted vertically relative to plane 30 by a distance approximately equal to centroid shift $\Delta y_E$. Should shift $\Delta y_E$ be zero, planes 30 and 30* are a single plane along which FIGS. 3*a* and 3*b* are both taken. Planes 30 and 30* appear as straight lines in FIG. 2.

The bell-shaped intensity profile in FIG. 3*a* for the situation of no $x_E$ shift in the baseline FED is relatively symmetric with respect to positions $x_3$ and $x_4$ at the left-hand and right-hand edges of wall-adjacent element 22. Unshifted centroid positions $x_{EU}$ and $x_{LU}$ for wall-adjacent element 22 thus both occur approximately halfway between edge positions $x_3$ and $x_4$, i.e., approximately at the peak of the intensity curve in FIG. 3*a*. This point is indicated as centroid position $x_U$ along the x axis.

The intensity profile in FIG. 3*b* for the situation of an $x_E$ shift in the baseline FED has a bell shape similar to that of the intensity profile of FIG. 3*a* but shifted due to electron deflections caused by the presence of spacer walls 14 or/and the occurrence of the display fabrication errors mentioned above. Although not shown in FIG. 3*b*, the shifted bell shape in FIG. 3*b* is slightly skewed because the trajectories of electrons closer to walls 14 are more affected by the presence of walls 14 than the trajectories of electrons further away from walls 14.

A large fraction of the area under the intensity curve in each of FIGS. 3*a* and 3*b* occurs between edge positions $x_3$ and $x_4$. As a result of this and the highly peaked nature of the curve portion between positions $x_3$ and $x_4$, the integration performed in Eq. 3 across area $A_L$ of wall-adjacent element 22 to determine shifted light-emitting centroid position $x_{LS}$ in FIG. 3*b* yields nearly the same value as the broader-area integration performed in Eq. 1 to determine shifted electron-striking centroid position $x_{ES}$ in FIG. 3*b* provided that the magnitude of electron-striking centroid shift $\Delta x_E$ is sufficiently small to avoid having a substantial fraction, e.g., 25% or more, of the incoming electrons miss wall-adjacent element 22 and cause inefficient electron-to-light conversion. Light-emitting centroid shift $\Delta x_L$ for the intensity curve of FIG. 3*b* is of slightly lesser magnitude than electron-striking centroid shift $\Delta x_E$, Hence, primary centroid shift radio $R_P$ is slightly less than, but fairly close to, 1 for the baseline FED provided that the $\Delta x_E$ magnitude is sufficiently small to have reasonable efficient operation in converting electrons to light.

In other words, the electron deflections resulting from the presence of spacer walls 14 or/and the occurrence of the above-mentioned fabrication errors cause the centroid of the light emitted from wall-adjacent element 22 in the baseline FED to move nearly as much in the x direction, i.e., perpendicular to walls 14, as the centroid of the electrons intended to strike wall-adjacent element 22. Since the magnitudes of the electrons deflections are typically greater for electrons emitted from light-emissive elements 22 closest to nearest walls 14, the shifting of the light-emitting centroids typically leads to non-uniform spacing between the rows of light-emitting centroids. Also, if the magnitudes of the electron deflections caused by walls 14 vary with time, the positions of the light-emitting centroids vary with time. The rows of light-emitting centroids thereby move back and forth. Both of these effects degrade the image provided by the baseline FED.

Figure 4A:
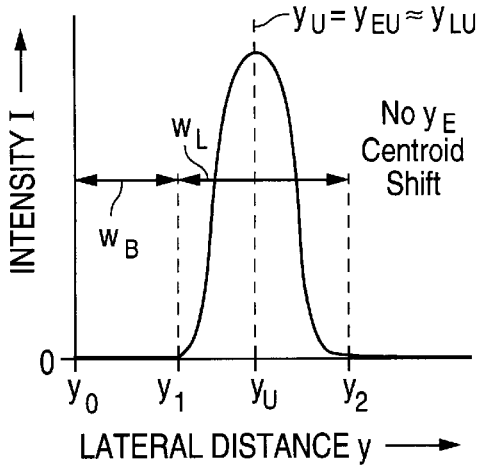
FIGS. 4*a* and 4*b* are bell-shaped profiles of intensity along part of the faceplate structure of the aforementioned baseline flat-panel display as a function of lateral distance parallel to the spacer walls for the respective situations of zero and non-zero intensity-centroid shift.
Figure 4B:
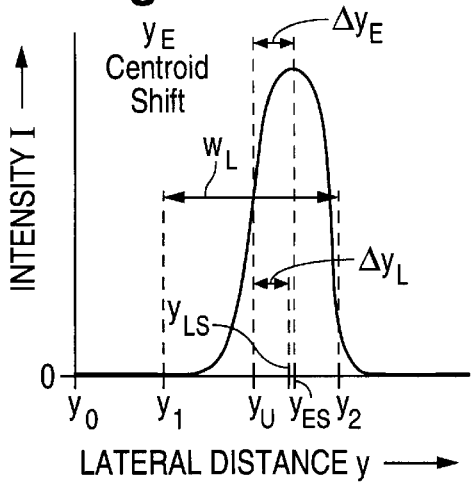

FIGS. 4*a* and 4*b* illustrate how electron-striking intensity $I_E$ varies with coordinate y along suitable locations extending in the y (further) direction through wall-adjacent element 22 in the baseline FED. Again with reference to the orientation used in FIG. 2, items $y_1$ and $Y_2$ in FIGS. 4*a* and 4*b* respectively are the y positions of the lower and upper edged of wall-adjacent element 22. Item $y_0$ is the y position of the upper edge of one of adjacent light-emissive elements 22.

FIG. 4*a* represents the situation in which there is no shift in electron-striking centroid position $y_E$. FIG. 4*b* represents the situation in which centroid position $y_E$ is shifted. Similar to FIGS. 3*a* and 3*b*, FIGS. 4*a* and 4*b* are taken along locations that pass through points where electron-striking intensity $I_E$ reaches its maximum magnitude in wall-adjacent light-emissive element 22. Since the maximum $I_E$ magnitude typically occurs approximately at the center of wall-adjacent element 22 when there is no $x_E$ shift, FIG. 4*a* depicts the variation of intensity $I_E$ along an imaginary plane 32 extending in the y (further) direction through the center of wall-adjacent element 22 in FIG. 2 generally perpendicular to (the exterior surface of) faceplate structure 12.

As indicated above, the occurrence of a shift in centroid position $x_E$ causes the location of the maximum $I_E$ magnitude to be shifted in the x direction by approximately centroid shift $\Delta x_E$. Accordingly, FIG. 4*b* depicts the variation of intensity $I_E$ along an imaginary plane 32* that extends in the y direction through wall-adjacent element 22 in FIG. 2 generally perpendicular. to faceplate structure 12. Plane 32* is shifted horizontally relative to plane 32 by a distance approximately equal to centroid shift $\Delta x_E$. Planes 32 and 32* appear as straight lines in FIG. 2.

For the baseline FED, the characteristics of centroid shifting in the y direction are quite similar to those in the x direction. Unshifted electron-striking centroid position $y_{EU}$ for wall-adjacent element 22 occurs at approximately the peak of the bell-shaped intensity profile in FIG. 4*a*. This point is indicated as position $y_U$ along the y axis. Unshifted centroid positions $y_{LU}$ and $y_{EU}$ are approximately the same.

Should any $y_E$ centroid shift occur in the baseline FED, shifted light-emitting centroid position $y_{LS}$ is quite close to shifted electron-striking centroid position $y_{ES}$ as shown in FIG. 4*b* provided that the magnitude of electron-striking centroid shift $\Delta y_E$ is sufficiently small to avoid inefficient operation caused by a substantially fraction of the incoming electrons missing wall-adjacent element 22. Light-emitting centroid shift $\Delta y_L$ is of slightly lesser magnitude than electron-striking centroid shift $\Delta y_E$. Further centroid shift ratio $R_F$ is thus slightly less than, but fairly close to, 1 provided that the $\Delta y_E$ magnitude is sufficiently small to have reasonably efficient electron-to-light conversion. Relative centroid shift ratio $R_P/R_F$ is roughly 1 for the baseline FED provided that the $\Delta x_E$ and $\Delta y_E$ magnitudes are both sufficiently small for the baseline FED to convert to light reasonably efficiently.

Figure 5A:
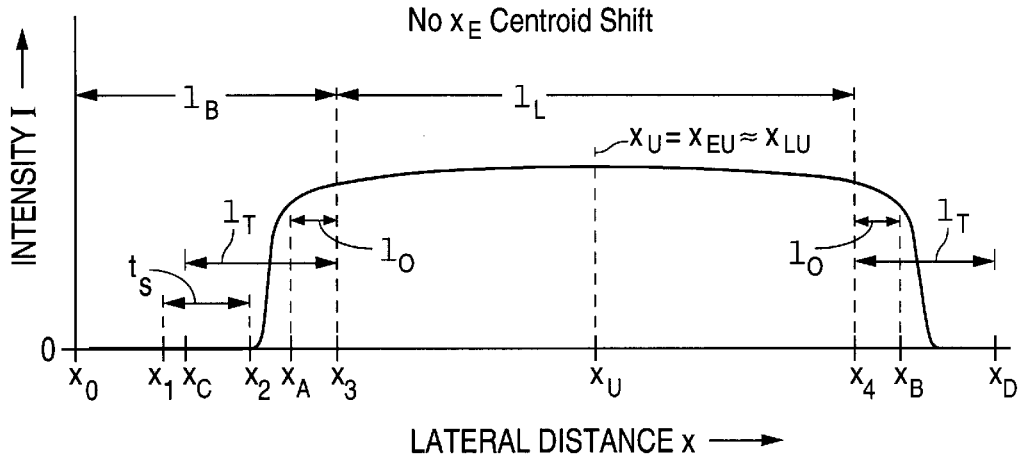
FIGS. 5*a* and 5*b* are profiles, shaped according to the invention, of intensity along part of the faceplate structure of the flat-panel display of FIGS. 1 and 2 as a function of lateral distance perpendicular to the walls of a spacer system in the display for the respective situations of zero and non-zero intensity-centroid shift.
Figure 5B:
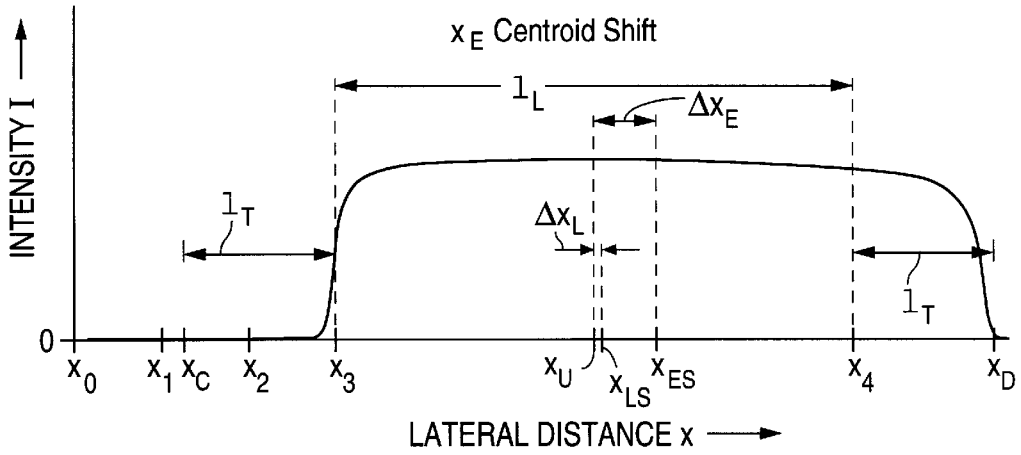

FIGS. 5*a* and 5*b* illustrate generally how intensity-profile shaping is performed in the x (primary) direction according to the invention for the FED of FIGS. 1 and 2 in order to substantially reduce image degradation due to electron deflections arising from effects such as the presence of spacer walls 14 or/and display fabrication errors of the above-mentioned type. The intensity profiles of FIGS. 5*a* and 5*b* are, for comparison purposes, taken respectively along substantially the same locations in faceplate structure 12 as those of FIGS. 3*a* and 3*b* for the baseline FED. Hence, FIG. 5*a* depicts how electron-striking intensity $I_E$ varies along plane 30 extending in the x direction through the center of wall-adjacent light-emissive element 22. FIG. 5*b* depicts the $I_E$ variation along plane 30* that extends in the x direction through wall-adjacent element 22.

Figure 6A:
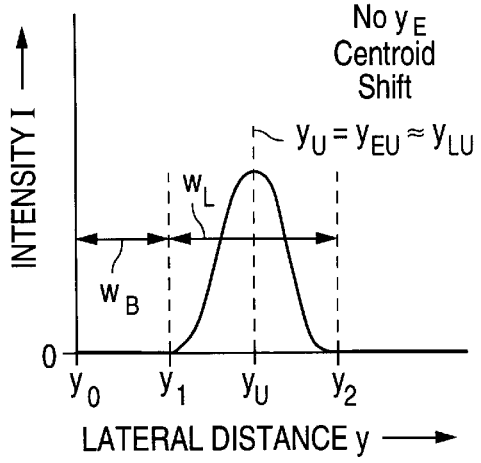
FIGS. 6*a* and 6*b* are bell-shaped profiles of intensity along part of the faceplate structure of the flat-panel display having the intensity profiles of FIGS. 5*a* and 5*b* as a function of lateral distance parallel to the spacer walls for the respective situations of zero and non-zero intensity-centroid
Figure 6B:
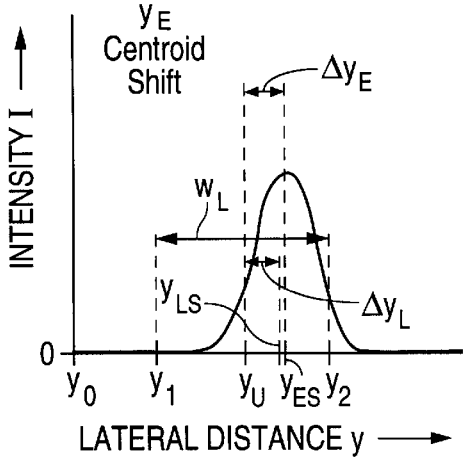

FIGS. 6*a* and 6*b* generally depict the intensity profiles in the y (further) direction for the FED of FIGS. 1 and 2 when the intensity profiles in the x direction are shaped generally as shown in FIGS. 5*a* and 5*b*. The intensity profiles of FIGS. 6*a* and 6*b* are, for comparison purposes, similarly taken respectively along substantially the same locations as those of FIGS. 4*a* and 4*b* for the baseline FED. Accordingly, FIG. 6*a* depicts how electron-striking intensity $I_E$ varies along plane 32 that extends in the y direction through the center of wall-adjacent element 22. FIG. 6*b* depicts the $I_E$ variation along plane 32* extending in the y direction through wall-adjacent element 22.

As in FIGS. 3*a*, 3*b*, 4*a*, and 4*b*, the intensity in FIGS. 5*a*, 5*b*, 6*a*, and 6*b* is specifically electron-striking intensity $I_E$. Within a region corresponding to a light-emissive element 22, the intensity in FIGS. 5*a*, 5*b*, 6*a*, and 6*b* also generally represents light-emitting intensity $I_L$ when the value of electron-striking intensity $I_E$ is relatively low.

FIGS. 5*a* and 6*a* respectively represent the $I_E$ distributions for the respective situations of no $x_E$ and $y_E$ centroid shifts. Because wall-adjacent element 22 is close to a spacer wall 14, the situation of precisely zero-$x_E$ shift typically does not arise for wall-adjacent element 22. The situation of zero-$x_E$ shift can be examined indirectly in various ways for wall-adjacent element 22. One way entails performing suitable computer modeling with spacer walls 14 absent in the, model. Another way is to examine a reference light-emissive element 22 situated far from walls 14 so that the effect of walls 14 or/and the above-mentioned fabrication errors on the trajectories of electrons that strike reference element 22 is small. Reference element 22 can, for example, be located approximately equidistant between two consecutive walls 14.

FIG. 5*b* represents the situation in which electron deflections resulting from the presence of spacer walls 14 or/and the occurrence of the indicated display fabrication errors cause a shift in centroid position $x_E$. FIG. 6*b* represents the situation in which centroid position $y_E$ is shifted. Walls 14 typically do not cause significant $y_E$ centroid shift. Accordingly, the $y_E$ shift shown in FIG. 6*b* is either caused by another effect, such as a misalignment resulting from a fabrication error, or simply indicates how the $I_E$ centroid would shift in the y direction due to some effect.

The intensity profile of FIG. 5*a* is much flatter than the baseline bell-shaped intensity profile of FIG. 3*a*, both profiles applying to the situation in which centroid $x_E$ is unshifted. The flatter intensity curve in FIG. 5*a* is achieved by appropriately adjusting the lateral shape and/or electron-emission density of electron-emission regions 20, and/or the focusing provided by the electron-focusing system.

The flatness of the intensity profile in FIG. 5*a* can be quantified in terms of the standard deviation a, of electron-striking intensity $I_E$ along the length $l_L$ of wall-adjacent element 22 from edge position $x_3$ to edge position $x_4$. Taking note of the fact that the intensity curve of FIG. 5*a* is taken along plane 30 that runs through the center of wall-adjacent element 22 in the x direction, the standard deviation $\sigma_I$ along the x-direction centerline of wall-adjacent element 22 is normally no more than 20% of the average value $I_{EA}$ of electron-striking intensity $I_E$ along the x-direction centerline of that element 22 between edge positions $x_3$ and $x_4$. This relationship applies to the situation of zero $x_E$ centroid shift.

The intensity profile in the x direction for FIG. 5*a* becomes flatter as standard deviation $\sigma_I$ decreases. For the situation of zero $x_E$ shift, standard deviation $\sigma_I$ along the x-direction centerline of wall-adjacent element 22 is preferably no more than 10%, more preferably no more than 5%, of average electron-striking intensity $I_{EA}$ along the x-direction centerline of that element 22. The foregoing flatness criteria, while given particularly for the x-direction centerline of wall-adjacent element 22, typically apply along any straight line extending through that element 22 in the x direction.

The $I_E$ intensity profile in FIG. 5*a* also has enhanced flatness in the x direction somewhat beyond the edges of wall-adjacent element 22 at positions $x_3$ and $x_4$. The enhanced x-direction intensity flatness outside wall-adjacent element 22 can be quantified in terms of the average value $I_{EO}$ of electron-striking intensity $I_E$ over a specified extension distance $l_O$ away from that element 22 in the x direction. In FIG. 5*a*, extension distance $l_O$ along plane 30 through the x-direction centerline of wall-adjacent element 22 is the distance from edge position $x_3$ to a position $x_A$ before position $x_3$, or the distance from edge position $x_4$ to a position $x_B$ after position $x_4$. Along the x-direction centerline of wall-adjacent element 22 for the situation in which there is no $x_E$ centroid shift, average outside electron-striking intensity $I_{EO}$ is normally at least 50% of average inside light-striking intensity $I_{EA}$ when extension distance $l_O$ is at least 10% of length $l_L$ of that element 22. Along the x-direction centerline of wall-adjacent element 22 for zero $x_E$ centroid shift, average outside intensity $I_{EO}$ is preferably at least 80% of average inside intensity $I_{EA}$ when distance $l_O$ is at least 10% of element length $l_L$.

Electron-striking intensity $I_E$ for electrons emitted by region 20 corresponding to wall-adjacent element 22 drops substantially to zero before reaching each nearest light-emissive element 22 in the x direction, i.e., in the same column, for the situation of no $x_E$ centroid shift and also typically for the situation of $x_E$ centroid shift up to the maximum normal $x_E$ shift. It is usually desirable that electrons emitted from region 20 corresponding to wall-adjacent element 22 not strike each nearest electron-emissive element 22 in the same column when electron-striking centroid shift $\Delta x_E$ reaches a high value. However, occasional unintended electron striking of a nearest light-emissive element 22 in the same column is usually tolerable because elements 22 in the same column all emit light of the same color.

In any event, electron-striking intensity $I_E$ normally falls to no more than 10% low of average inside intensity $I_{EA}$ before reaching a specified effective termination distance $l_T$ away from wall-adjacent spacer 22 in the x direction for the situation of zero $x_E$ centroid shift. In FIG. 5*a*, the termination distance $l_T$ along plane 30 through the x-direction centerline of wall-adjacent element 22 is the distance from edge position $x_3$ to a position $x_C$ before position $x_3$, or the distance from edge position $x_4$ to a position $x_D$ after position $x_4$. Distance $l_T$ is normally no more than 80%, preferably no more than 50%, more preferably no more than 30%, of distance $l_B$ to each nearest electron-emissive element 22 in the x direction. By making distance $l_T$ relatively small, the efficiency of converting electrons to light is relatively high in the x direction.

The intensity profile in FIG. 5*a* is relatively symmetric with respect to positions $x_3$ and $x_4$ at the left-hand and right-hand edges of wall-adjacent element 22. Due to this near symmetry and the relatively flat nature of the intensity profile, unshifted centroid positions $x_{EU}$ and $x_{LU}$ both occur at position $x_U$ approximately halfway between edge positions $x_3$ and $x_4$. The enhanced flatness of the intensity curve in FIG. 5*a* arises because, on the average, impinging electrons strike wall-adjacent element 22 further away from position $x_U$ than occurs with the intensity profile of FIG. 3*a*.

The intensity profile in FIG. 5*b* for the situation of $x_E$ centroid shift has a flat shape similar to that of FIG. 5*a* but shifted due to electron deflections caused by spacer walls 14 or/and the indicated display fabrication errors. The $x_E$ centroid shift, although shown as being to the right in FIG. 5*b*, can be to the right or left. Due to the increased flatness, the curve portion between edge positions $x_3$ and $x_4$ in FIG. 5*b* is roughly the same as the curve portion between positions $x_3$ and $x_4$ in FIG. 5*a* provided that the magnitude of electron-striking centroid shift $\Delta x_E$ is not too large. The integrations performed with Eq. 3 across area $A_L$ of wall-adjacent element 22 to determine light-emitting centroid position $x_L$ thereby produce relatively close values for unshifted value $x_{LU}$ and shifted value $x_{LS}$. Consequently, light-emitting centroid shift $\Delta x_L$ for the intensity curve of FIG. 5*b* is of much lesser magnitude than electron-striking centroid shift $\Delta x_E$ again provided that the $\Delta x$, magnitude is not too large.

More particularly, primary centroid shift ratio $R_P$ here is normally no more than 0.5 when the magnitude of centroid shift $\Delta x_E$ is in a primary shift range from zero to at least 2% of length $l_L$ of wall-adjacent element 22. Although wall-adjacent element 22 is typically rectangular, it can have a non-rectangular shape. Taking note of the fact that length $l_L$ is the mean dimension of wall-adjacent element 22 in the x direction, the general requirement on shift ratio $R_P$ is that it be no more than 0.5 when the $x_E$ magnitude is in the primary shift range from zero to at least 2% of the mean dimension of wall-adjacent element 22 in the x (primary) direction.

Primary centroid shift ratio $R_P$ is preferably no more than 0.35, more preferably no more than 0.25, when the $\Delta x_E$ magnitude is in the primary shift range. The upper value of the primary shift range is preferably at least 5%, more preferably at least 10%, of the mean dimension of wall-adjacent element 22 in the x direction. For a typical situation in which length $l_L$ is approximately 200 $\mu$m, the upper values of the primary shift range at the 2%, 5%, and 10% points respectively are approximately 4, 10, and 20 $\mu$m.

In short, when an effect such as the presence of spacer walls 14, causes an $x_E$ centroid shift, use of the intensity profile of FIG. 5*a* results in a light-emitting $x_L$ centroid shift considerably less than the $x_E$ shaft. The above-described problem involving non-uniform spacing between the rows of light-emitting centroids and the back-and-forth movement of the rows of light-emitting centroids are substantially alleviated with the intensity profile of FIG. 5*a*.

The intensity profile of FIG. 6*a* for the situation of no $y_E$ centroid shift is generally shaped like a bell and is quite similar to the intensity profile of FIG. 4*a*, except that the peak intensity magnitude is lower in FIG. 6*a* than in FIG. 4*a*. The difference in peak intensity magnitude does not significantly affect the characteristics of centroid shifting in the y direction. As a comparison of FIGS. 6*a* and 6*b* to FIGS. 4*a* and 4*b* indicates, the y-direction centroid-shift characteristics which arise with the intensity profile of FIG. 6*a* are quite similar to those which arise with the intensity profile of FIG. 4*a*.

To the extent that any $y_E$ centroid shift actually occurs with the profile of FIG. 6*a*, shifted light-emitting centroid position $y_{LS}$ is quite close to shifted electron-striking centroid position $y_{ES}$ as indicated in FIG. 6*b* provided that the magnitude of electron-striking centroid shift $\Delta y_E$ is sufficiently small to have reasonably efficient electron-to-light conversion. Similar to what occurs with the bell shaped intensity profiles in FIGS. 3*b* and 4*b*, the bell shape in FIG. 6*b* is slightly skewed (not shown in FIG. 6*b*) because electrons closer to walls 14 are more affected by walls 14 than electrons further away from walls 14. Light-emitting centroid shift $\Delta y_L$ is again of slightly lesser magnitude than electron-striking centroid shift $\Delta y_E$.

The result is that further centroid shift ratio $R_F$ is again slightly less than, but fairly close to, 1. This is, of course, subject to electron-striking centroid shift $\Delta y_E$ being of suitably small magnitude. In particular, the magnitude of centroid shift $\Delta y_E$ is in a further shift range from zero to 2% or more of width $w_L$ of wall-adjacent element 22. Inasmuch as wall-adjacent element 22 can have a non-rectangular shape, shift ratio $R_F$ for the intensity profile of FIG. 6*a* is generally expressed as being slightly less than, but fairly close to, 1 when the $\Delta y_E$ magnitude is in the further shift range from zero to 2%. of the mean dimension of wall-adjacent element 22 in the y (further) direction.

The upper value of the further shift range can be 10% or more of the mean dimension of wall-adjacent element 22 in the y direction. Nevertheless, any $y_E$ centroid shift that may arise due to spacer walls 14 is normally quite small. Hence, no significant image degradation occurs due to light-emitting centroid shift $\Delta y_L$ being of nearly the same magnitude as electron-striking centroid shift $\Delta y_E$. With further centroid shift ratio $R_F$ being fairly close to 1 under the indicated conditions, the y-direction efficiency of producing light as the result of electrons striking faceplate structure 12 is quite high.

Importantly, relative centroid shift ratio $R_P/R_F$ for the composite intensity profile of FIGS. 5*a* and 6*a* is normally no more than 0.75 when the magnitudes of electron-striking centroid shifts $\Delta x_E$ and $\Delta y_E$ are respectively in the primary and further shift ranges given above. That is, the maximum $R_P/R_F$ value is 0.75 when the $\Delta x_E$ magnitude ranges from zero to an upper value of at least 2%, preferably at least 5%, more preferably at least 10%, of the mean dimension of wall-adjacent element 22 in the x direction and when the $\Delta y_E$ magnitude ranges from zero to an upper value of at least 2%, potentially at least 10%, of the mean dimension of wall-adjacent element 22 in the y direction. This arises because primary centroid shift ratio $R_P$ is considerably less than 1.

Relative centroid shift ratio $R_P/R_F$ for the composite intensity profile of FIGS. 5*a* and 6*a* is preferably no more than 0.5, more preferably no more than 0.35, under the foregoing conditions. The composite intensity profile of FIGS. 5*a* and 6*a* thereby substantially reduces image degradation that can arise from electron deflections toward, or away from, spacer walls 14 without detrimentally affecting performance characteristics parallel to walls 14.

Figure 7A:
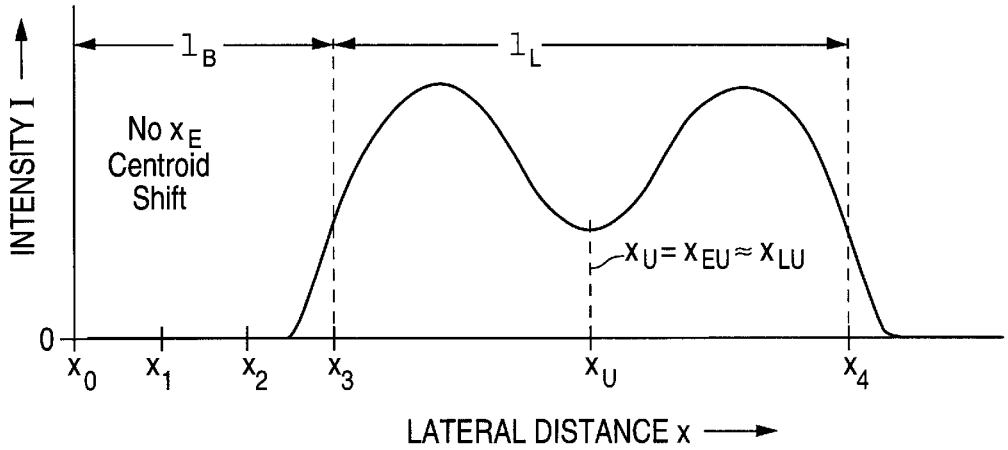
FIGS. 7*a* and 7*b* are profiles, shaped according to the invention, of intensity along part of the faceplate structure of the flat-panel display of FIGS. 1 and 2 as a function of lateral distance perpendicular to the walls of a spacer system in the display for the respective situations of zero and non-zero intensity-centroid shift.
Figure 7B:
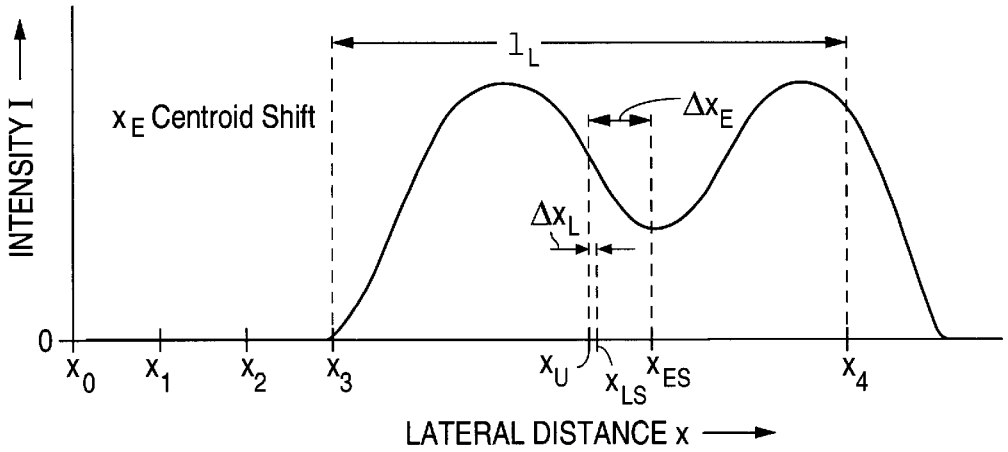
Figure 8A:
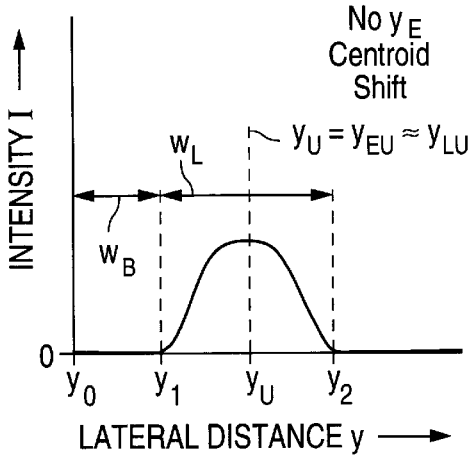
FIGS. 8*a* and 8*b* are bell-shaped profiles of intensity along part of the faceplate structure of the flat-panel display having the intensity profiles of FIGS. 7*a* and 7*b* as a function of lateral distance parallel to the spacer walls for the respective situations of zero and non-zero intensity-centroid shift.
Figure 8B:
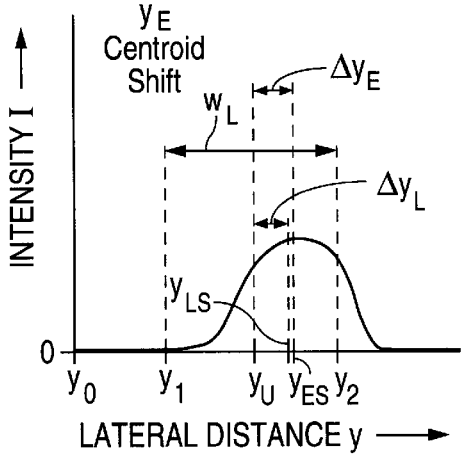

FIGS. 7*a* and 7*b* illustrate how the intensity-profile shaping in the x (primary) direction for the FED of FIGS. 1 and 2 is extended beyond that shown in FIGS. 5*a* and 5*b* so as to further reduce image degradation caused by electron deflections arising from effects such as the presence of spacer walls 14 or/and fabrication errors of the type mentioned above. FIGS. 8*a* and 8*b* generally depict the intensity profiles in the y (further) direction for the FED of FIGS. 1 and 2 when the intensity profiles in the x direction are generally shaped as depicted in FIGS. 7*a* and 7*b*. The intensity in FIGS. 7*a*, 7*b*, 8*a*, and 8*b* is specifically electron-striking intensity $I_E$. Within a region corresponding to a light-emissive element 22, the intensity in FIGS. 7*a*, 7*b*, 8*a*, and 8*b* also generally represents light-emitting intensity $I_L$ when electron-striking intensity $I_E$ is relatively low in value.

The intensity profiles of FIGS. 7*a* and 7*b* are taken along the same respective locations in faceplate structure 12 as those of FIGS. 5*a* and 5*b*, and thus along the same respective locations in plate structure 12 as the baseline profiles of FIGS. 3*a* and 3*b*. Accordingly, FIG. 7*a* depicts the variation of electron-striking intensity $I_E$ along plane 30 extending in the x direction through the center of wall-adjacent light-emissive element 22 in FIG. 2. FIG. 7*b* depicts the $I_E$ variation along plane 30* extending in the x direction through wall-adjacent element 22. As mentioned above, planes 30 and 30* are vertically separated from each other by approximately centroid shift $\Delta y_E$. Should shift $\Delta y_E$ be zero, FIG. 7*a* and 7*b* are taken along the same x-direction plane that results from merging plane 30* into plane 30.

Similarly, the intensity profiles of FIGS. 8*a* and 8*b* are taken along the same respective locations in faceplate structure 12 as those of FIGS. 6*a* and 6*b*, and thus along the same respective locations in faceplate structure 12 as the baseline profiles of FIGS. 4*a* and 4*b*. Hence, FIG. 8*a* depicts the variation of electron-striking intensity $I_E$ along plane 12 extending in the y direction through the center of wall-adjacent element 20 in FIG. 2. FIG. 8*b* depicts the $I_E$ variation along plane 32* extending in the y direction through wall-adjacent element 22. As mentioned above, planes 32 and 32* are horizontally separated from each other by approximately centroid shift $\Delta x_E$.

FIGS. 7*a* and 8*a* represent the $I_E$ distributions in accordance with the invention for the respective situations of no $x_E$ and $y_E$ shifts. The comments made above about the zero-$x_E$ shift situation typically not arising with wall-adjacent element 22 apply to the $I_E$ profile of FIG. 7*a*. FIG. 7*b* represents the situation in which electron deflections arising from the presence of spacer walls 14 or/and the occurrence of the above-mentioned display fabrication errors cause centroid position $x_E$ to shift. FIG. 8*b* represents the situation in which centroid position $y_E$ is shifted. Inasmuch as walls 14 typically do not cause significant $y_E$ shift, the $y_E$ shift shown in FIG. 8*b* either results from one or more other effects, such as fabrication-caused alignment error, or simply indicates how intensity $I_E$ would shift in the y direction due to some defect.

The inventive intensity profile of FIG. 7*a* for the zero-$x_E$ shift situation is basically shaped like a double hump with a substantial local minimum between the two humps. The double-humped profile is relatively symmetric with respect to positions $x_3$ and $x_4$ at the left-hand and right-hand edges of wall-adjacent light-emissive element 22. Consequently, unshifted intensity positions $x_{EU}$ and $x_{IU}$ again both occur at position $x_U$ approximately halfway between edge positions $x_3$ and $x_4$. Also, the local minimum in the double hump occurs at, or close to, position $x_U$.

The local maxima of both intensity humps in FIG. 7*a* occur within wall-adjacent element 22, i.e., between edge positions $x_3$ and $x_4$. Intensity $I_E$ drops substantially to zero before reaching each light-emissive element 22 closest in the x direction, i.e., in the same column, to wall-adjacent element 22. This occurs for the unshifted $x_E$ centroid situation depicted in FIG. 7*a* and also typically for the shifted $x_E$ centroid situation represented in FIG. 7*b* up to the maximum normal value of the $x_E$ shift. In fact, intensity $I_E$ normally drops substantially to zero well before reaching each nearest element 22 in the x direction, thereby enabling the electron-to-light conversion efficiency to be quite high in the x direction for the double-humped profile. As with the example represented in FIGS. 5*a* and 5*b*, it is usually tolerable for electrons to occasionally strike a nearest light-emissive element 22 in the same column as wall-adjacent element 22 because the light emitted by elements 22 in any particular column is the same color.

The intensity profile in FIG. 7*b* for the shifted $x_E$ centroid situation has a double-humped shape similar to that of FIG. 7*a* but shifted due to electron deflections caused by spacer walls 14 or/and the display fabrication errors mentioned above. Although FIG. 7*b* illustrates an $x_E$ shift to the right, an $x_E$ shift to the left can also occur. The intensity profiles in FIGS. 7*a* and 7*b* are typically somewhat flatter than those of FIGS. 3*a* and 3*b* but not as flat as the intensity profiles of FIGS. 5*a* and 5*b*.

The presence of the intensity minimum in the profile of FIG. 7*a* results in primary centroid shift ratio $R_P$ being no more than 0.5, the maximum value that typically occurs with the profile of FIG. 5*a*, again provided that the magnitude of electron-striking centroid shift $\Delta x_E$ is in the primary shift range mentioned above. As with the profile of FIG. 5*a*, primary centroid shift ratio $R_P$ for the example of FIG. 7*a* is preferably no more than 0.35, more preferably no more than 0.25, when the $\Delta x_E$ magnitude is in the primary shift range. In fact, by appropriately controlling the shape of the double hump, especially the portion that contains the local minimum, a double-humped intensity profile of the type represented by FIG. 7*a* can readily achieve a lower $R_P$ value than the flattened intensity profile represented by FIG. 5*a*. As discussed below in connection with FIGS. 10*a* and 10*b*, primary centroid shift ratio $R_P$ for a double-humped intensity profile can be made quite close to the ideal value of zero.

The intensity profiles of FIGS. 8*a* and 8*b* for the unshifted and shifted $y_E$ centroid positions are quite similar to the corresponding intensity profiles of FIGS. 6*a* and 6*b*, and thus to the corresponding intensity profiles of FIGS. 4*a* and 4*b*. The only notable difference is that the peak intensity magnitude is lower in FIGS. 8*a* and 8*b* than in FIGS. 6*a* and 6*b*, and thus also lower than in FIGS. 4*a* and 4*b*. As mentioned above, the different in peak intensity magnitude does not significantly affect the characteristics of the centroid shifting in the y direction. Accordingly, the comments presented above about $y_E$ centroid shifting for the intensity profile of FIG. 6*a* apply generally to the intensity profile of FIG. 8*a*. In particular, further centroid shift ratio $R_F$ for the intensity profile of FIG. 8*a* is slightly less than, but fairly close to, 1 when the magnitude of electron-striking centroid shift $\Delta y_E$ is in the further shift range mentioned above. Hence, the y-direction efficiency of producing light as a result of electrons striking faceplate structure 12 is quite high.

Relative centroid shift ratio $R_P/R_F$ for the composite intensity profile of FIGS. 7*a* and 8*a* is normally no more than 0.75, the maximum value that typically occurs with the composite intensity profile of FIGS. 5*a* and 6*a*, again provided that the magnitudes of electron-striking centroid shifts $\Delta x_E$ and $\Delta y_E$ are respectively in the primary and further shift ranges mentioned above. This arises because primary centroid shift ratio $R_P$ is considerably less than 1 for the double-humped profile of FIG. 7*a*.

As with the composite intensity profile of FIGS. 5*a* and 6*a*, relative ratio $R_P/R_F$ for the composite profile of FIGS. 7*a* and 8*a* is preferably no more than 0.5, more preferably no more than 0.35, when the $\Delta x_E$ and $\Delta y_E$ magnitudes are respectively in the primary and further shift ranges. Since the double-humped profile of FIG. 7*a* can readily attain a lower value of primary centroid shift ratio $R_P$ than the flattened profile of FIG. 5*a*, the composite intensity profile of FIGS. 7*a* and 8*a* can readily achieve a lower value of relative shift ratio $R_P/R_F$ than the composite intensity profile of FIGS. 5*a* and 6*a*. Accordingly, the composite intensity profile of FIGS. 7*a* and 8*a* substantially alleviates image degradation that would otherwise arise from electron deflections towards, or away from, spacer walls 14 without damaging the performance characteristics parallel to walls 14.

The shape of the intensity profile illustrated in FIG. 7*a* is somewhat simplified. Due to manufacturing variations and other non-idealities, the actual shape of an intensity profile intended to implement that of FIG. 7*a* may be somewhat jagged in shape. The actual jagged profile may, for example, include multiple upward and downward intensity spikes.

Local variations in an intensity profile of jagged shape can be smoothed out by applying a 10% moving average to the intensity profile. In a 10% moving average profile for a parameter such as intensity, the value of the parameter at any point in the actual profile is replaced with the average value of the parameter along a line centered on that point, where the line's length is 10% of a characteristic dimension of the profile. For the intensity profile of wall-adjacent light-emissive element 22 in the x (primary) direction, the characteristic dimension is conveniently chosen to be the mean dimension of wall-adjacent element 22 in the x direction, i.e., length $l_L$ for the illustrated rectangular implementation of wall-adjacent element 22. In a 10% moving average intensity profile across wall-adjacent element 22 in the x direction through a plane generally perpendicular to faceplate structure 12 or backplate structure 10, the 10% moving average intensity at any point is the average of electron-striking intensity $I_E$ in the x direction through that point across (a) a distance of 5% of length $l_L$ before that point and (b) a distance of 5% of length $l_L$ after that point.

Figure 9:
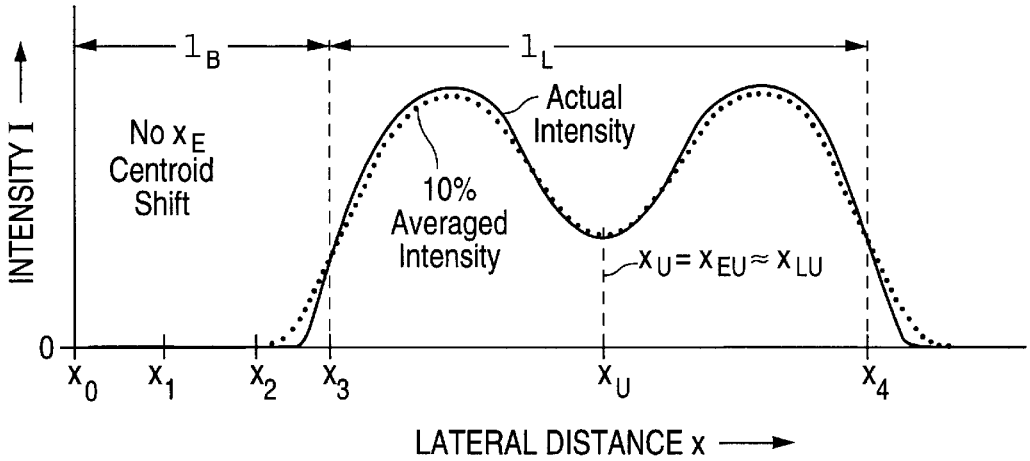
FIG. 9 is a graph for comparing the intensity profile of FIG. 7*a* to a corresponding 10% moving average intensity profile.

FIG. 9 illustrates the result of applying a 10% moving average to the intensity profile of FIG. 7*a*. The solid line in FIG. 9 represents the actual intensity profile of FIG. 7*a*. The dotted line in FIG. 9 is a corresponding 10% moving average intensity profile in the x direction across wall-adjacent element 22 through plane 30.

As FIG. 9 indicates, use of the 10% moving average causes the high $I_E$ values to be slightly reduced and the lower $I_E$ values to be slightly increased. Nonetheless, the 10% moving average intensity profile is shaped quite similar to the actual $I_E$ profile. Although the actual $I_E$ profile in FIG. 9 is relatively smooth, a 10% moving average intensity profile very similar to that shown in FIG. 9 arises when the actual $I_E$ profile in the x direction has a jagged generally double-humped shape of the type described above. The 10% moving average substantially eliminates large local $I_E$ variations, including those causes by measurement error and other noise, while maintaining the essential characteristics of the $I_E$ profile.

Use of the 10% moving average intensity profile in FIG. 9 permits certain intensity magnitude parameters to be quantitatively described for electron-striking intensity $I_E$ in the x direction. The 10% moving average intensity profile has a double-humped shape similar to the idealized intensity profile in FIG. 7*a*. A local minimum in the 10% moving average intensity profile occurs approximately at position $x_U$ between the humps.

The value of the 10% moving average intensity profile at the local minimum is normally no more than 95% of the maximum intensity value of the 10% moving average profile. That is, the 10% moving average intensity value at the local minimum is at least 5% less than the maximum 10% moving average intensity value. Inasmuch as the 10% moving average profile is largely symmetric with respect to edge positions $x_3$ and $x_4$, the maximum 10% moving average intensity value is the 10% moving average intensity value at the top of either hump. The 10% moving average intensity value at the local minimum is preferably no more than 90%, more preferably no more than 80%, of the maximum 10% moving average intensity value.

Rather than using a moving average technique to convert a potentially jagged intensity profile into a smoothed intensity profile that closely reflects the potentially jagged one, a very similar result is achieved by taking advantage of the fact that faceplate structure 12 contains an array of largely identical light-emissive elements 22 so as to perform intensity averaging over multiple elements 22, e.g., all of elements 22 in structure 12. For this purpose, the intensity profile in each of FIGS. 3*a*, 3*b*, 4*a*, 4*b*, 5*a*, 5*b*, 6*a*, 6*b*, 7*a*, 7*b*, 8*a*, and 8*b* can be the composite average intensity profile for all of light-emissive elements 22 at the various conditions specified for those figures. The intensity in each of these eight figures is then the composite average electron-striking intensity $\bar{I}_E$ for elements 22. Within regions corresponding to elements 22, the intensity in these figures also represents the composite average light-emitting intensity $\bar{I}_L$ for elements 22 at low average electron-striking intensity $\bar{I}_E$.

Similarly, each distance or centroid parameter in FIGS. 3*a*, 3*b*, 4*a*, 4*b*, 5*a*, 5*b*, 6*a*, 6*b*, 7*a*, 7*b*, 8*a*, and 8*b* represents the corresponding average distance or centroid parameter for all of light-emissive elements 22. For example, centroid shifts $\Delta x_E$, $\Delta y_E$, $\Delta x_L$, and $\Delta y_L$ in these eight figures then respectively represent average electron-striking centroid shift $\Delta\bar{x}_E$ and $\Delta\bar{y}_E$ and average light-emitting centroid shifts $\Delta\bar{x}_L$ and $\Delta\bar{y}_L$ for elements 22. Eqs. 11 and 12 then respectively become:

$$\bar{R}_P = \frac{\Delta\bar{x}_L}{\Delta\bar{x}_E} = \frac{\bar{x}_{LS} - \bar{x}_{LU}}{\bar{x}_{ES} - \bar{x}_{EU}} \tag{13}$$

$$\bar{R}_F = \frac{\Delta\bar{y}_L}{\Delta\bar{y}_E} = \frac{\bar{y}_{LS} - \bar{y}_{LU}}{\bar{y}_{ES} - \bar{y}_{EU}} \tag{14}$$

where $\bar{R}_P$ and $\bar{R}_F$ respectively are the average primary and further centroid shift ratios for elements 22. Average centroid shifts $\Delta\bar{x}_E$, $\Delta\bar{y}_E$, $\Delta\bar{x}_L$, and $\Delta\bar{y}_L$ are determined by respectively averaging individual centroid shifts $\Delta x_E$, $\Delta y_E$, $\Delta x_L$, and $\Delta y_L$ over elements 22 in a linear manner.

All of the properties described above for the inventive intensity profiles of FIGS. 5*a*, 5*b*, 6*a*, 6*b*, 7*a*, 7*b*, 8*a*, and 8*b* are now directly translated into corresponding average properties using the foregoing average parameters. Specifically, average primary centroid shift ratio $\bar{R}_P$ is normally no more than 0.5, preferably no more than 0.35, more preferably no more than 0.25, when the magnitude of average electron-striking centroid shift $\Delta\bar{x}_E$ is in a primary average shift range from zero to at least 2%, preferably at least more preferably at least 10%, of the average mean dimension of light-emissive elements 22 in the x (primary) direction. Similarly, average further centroid shift ratio $\bar{R}_F$ is slightly less than, but close to, 1 when the magnitude of average electron-striking centroid shift $\Delta\bar{Y}_E$ is in a further average shift range from zero to at least 2%, potentially at least 10%, of the average mean dimension of elements 22 in the (further) direction. Resulting average relative centroid shift ratio $\bar{R}_P/\bar{R}_F$ is then normally no more than 0.75, preferably no more than 0.5, more preferably no more than 0.35, when the magnitude of average centroid shifts $\Delta\bar{x}_E$ and $\Delta\bar{y}_E$ are respectively in the primary and further average shift ranges.

The following arises when the foregoing composite averaging technique is applied to the inventive intensity profiles of FIGS. 7*a*, 7*b*, 8*a*, and 8*b*. The compose profile of average electron-striking intensity $\bar{I}_E$ represented in FIG. 7*a* has a local minimum at the location of approximately the average position of the centers of light-emissive elements 22. The value of the $\bar{I}_E$ profile at the location of the local minimum is normally no more than 95%, preferably no more than 90%, more preferably no more than 80%, of the maximum intensity value of the composite $\bar{I}_E$ average intensity profile.

The minimum number of light-emissive elements 22 used in the intensity averaging is four since elements 22 are arranged in a two-dimensional array. More, preferably at least 10, more preferably at least 100, of elements 22 are normally employed in the intensity averaging. In some cases, the intensity averaging can be performed with elements 22 in one row or column rather than with all of elements 22 in faceplate structure 12.

Figure 10A:
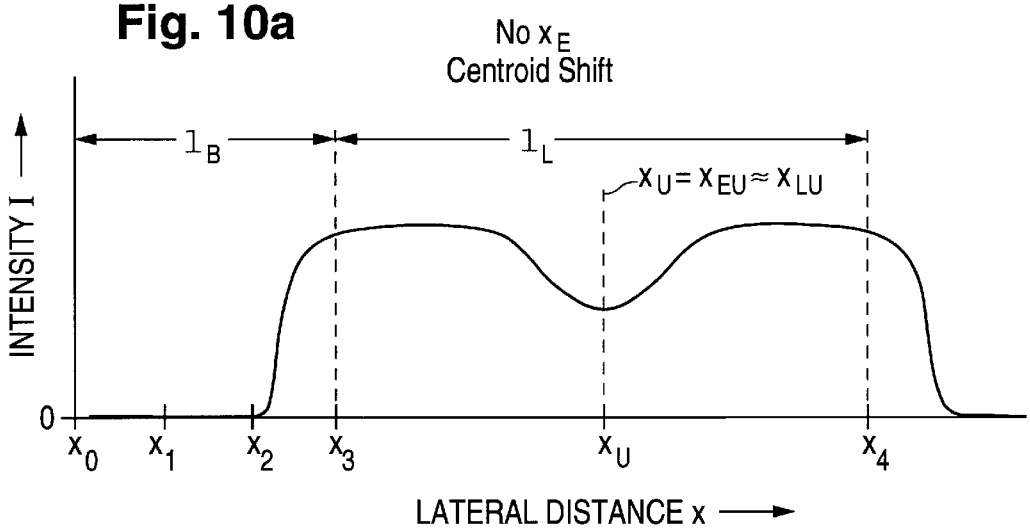
FIGS. 10*a* and 10*b* are profiles, shaped according to the invention, of intensity along part of the faceplate structure of the flat-panel display of FIGS. 1 and 2 as a function of lateral distance perpendicular to the walls of a spacer system in the display for the respective situations of zero and non-zero intensity-centroid shift.
Figure 10B:
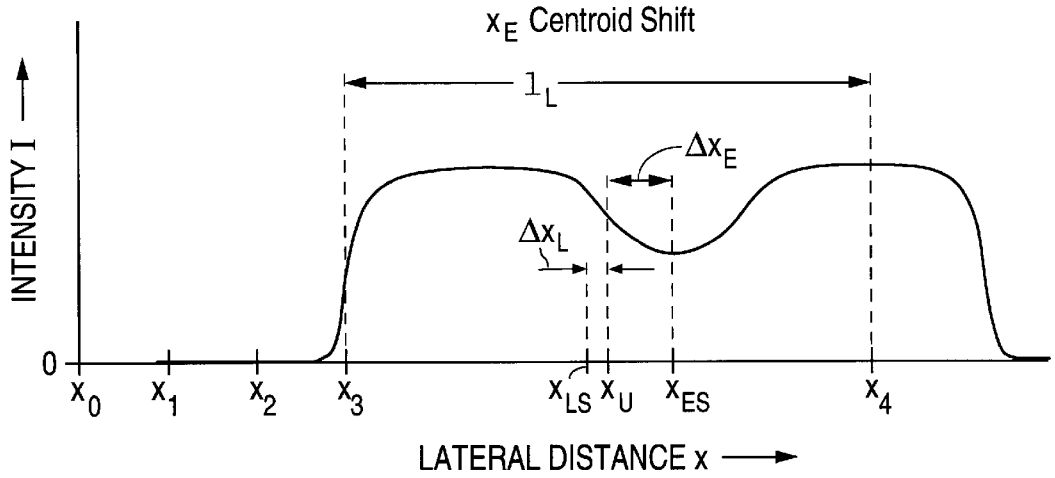

As mentioned above, use of the double-humped shape for the $I_E$ profile in the x direction for wall-adjacent element 22 enables primary centroid shift ratio $R_P$ to be made close to zero when electron-striking centroid shift $\Delta x_E$ is in the primary shift range. FIGS. 10*a* and 10*b* illustrate an extended example of how the double-humped shape can be employed to make primary centroid shift ratio $R_P$ less than zero. FIG. 10*a* represents the zero-$x_E$ shift situation. FIG. 10*b* represents the $x_E$ shifted situation for which light-emitting centroid shift $\Delta x_L$ is of opposite sign to electron-striking centroid shift $\Delta x_E$. Hence, primary centroid shift ratio $R_P$ is negative. This example is achieved by simply adjusting the shapes of the two humps. While a negative $R_P$ value is normally no more helpful than a positive $R_P$ value of the same magnitude, the example of FIGS. 10*a* and 10*b* demonstrates the great flexibility available with an intensity profile having a substantial local minimum.

Rather than two humps, an electron-striking intensity profile having a substantial local minimum in accordance with the invention may have three or more, normally an even number of humps, across wall-adjacent light-emissive element 22 in the x direction. In the case where there is an even number of four or more humps, one half of the humps are situated on one side of position $x_U$. The other half of the humps are situated on the other side of position $x_U$ typically gubgtantially symmetric relative to the first half of the humps for the zero-$x_E$ shift situation. A substantial local intensity minimum occurs at or close to the position $x_U$ between the middle two humps. An additional local intensity minimum occurs between each other pair of adjacent humps. The intensity profile for this variation normally has the 10%. moving average characteristics described above for the double-humped example, particularly with respect to the intensity minimum between the middle two humps. Likewise, when intensity averaging is performed over all of light-emissive elements 22, the composite average intensity profile for this variation has the characteristics described above for the double-humped example. Image degradation is again substantially reduced.

Figure 11:
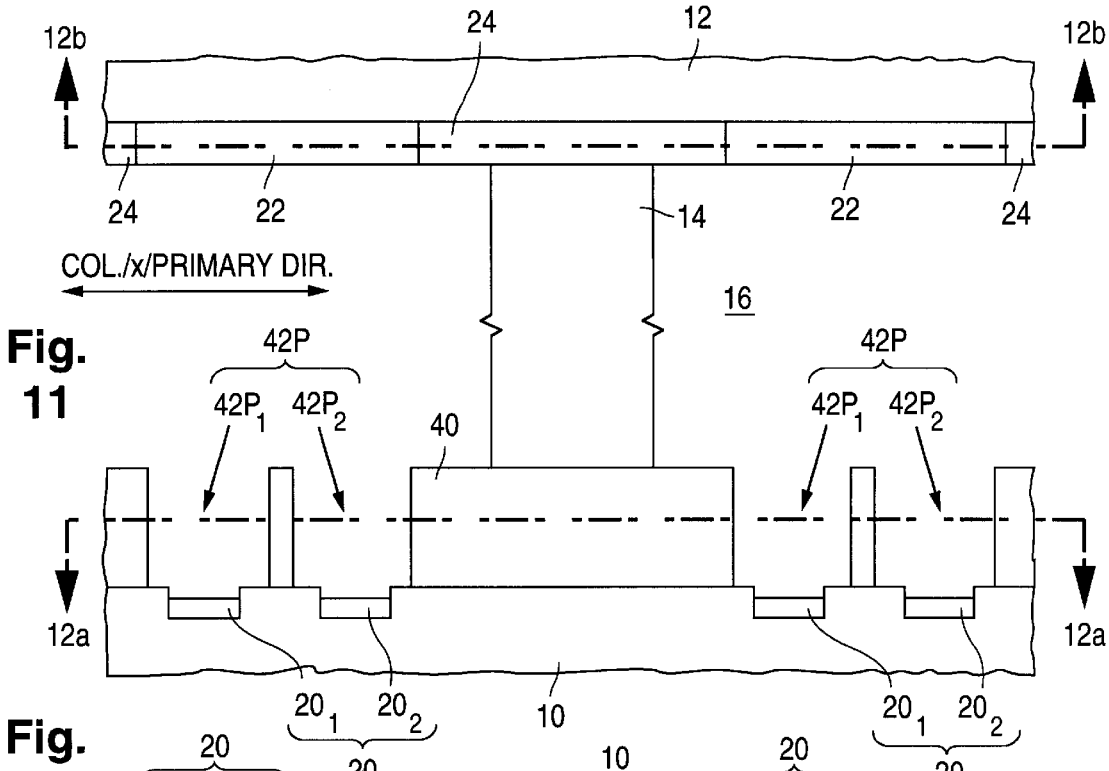
FIG. 11 is a cross-sectional side view of part of a general embodiment of the flat-panel display of FIGS. 1 and 2 as implemented in accordance with the invention to achieve the intensity profiles of FIGS. 7*a* and 8*a*.
Figure 12A:
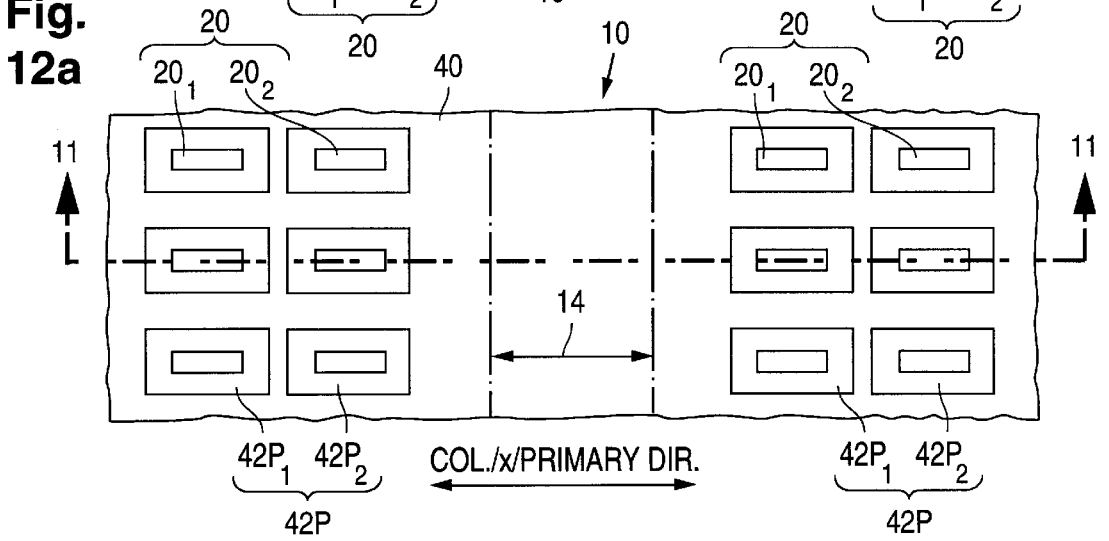
FIGS. 12*a* and 12*b* are respective cross-sectional layout views of portions of the backplate and faceplate structures in the flat-panel display of FIG. 11. The cross section of FIG. 11 is taken through plane 11—11 in FIGS. 12*a* and 12*b*. The cross sections of FIGS. 12*a* and 12*b* are taken respectively through planes 12*a*–12*a* and 12*b*–12*b* in FIG. 11.
Figure 12B:
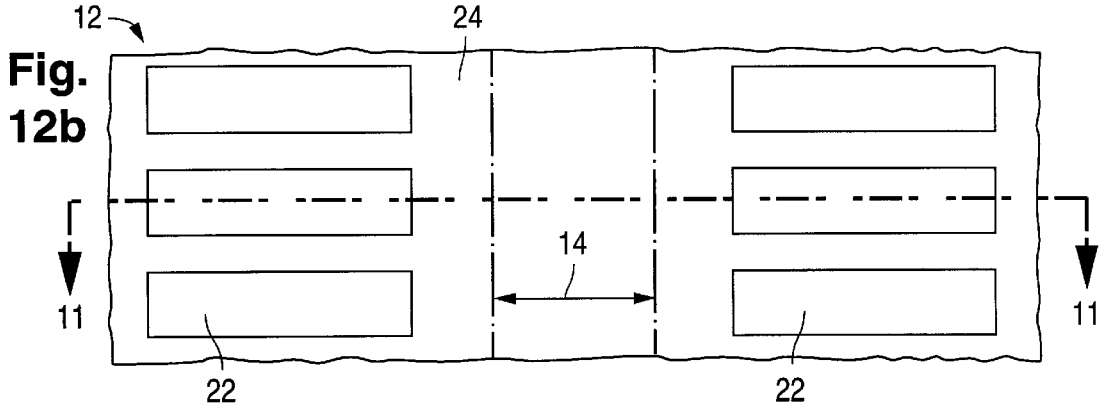

FIG. 11 illustrates a side cross section of part of a general embodiment of the FED of FIGS. 1 and 2 configured in accordance with the invention to achieve the inventive intensity profile of FIGS. 7*a* and 8*a*. A cross-sectional layout of the portion of backplate structure 10 in FIG. 11 is depicted in FIG. 12*a*. A cross-sectional layout of the portion of faceplate structure 12 in FIG. 11 is depicted in FIG. 12*b*. Plane 11—11 in FIGS. 12*a* and 12*b* corresponds to plane 30 in FIG. 2. The dot-and-dash lines in FIGS. 12*a* and 12*b* indicate the relative location of one spacer wall 14.

Taking note of the fact that each light-emissive element 22 is located opposite a corresponding electron-emissive region 20, each region 20 in the embodiment of FIGS. 11 and 12 consists of a plurality of N laterally separated electron-emissive portions 20, $\mathbf{20}_2$, . . . $\mathbf{20}_N$. When an electron-emissive region 20 is activated, all of portions $\mathbf{20}_1$–$\mathbf{20}_N$ in that region 20 simultaneously emit electrons. The electrons emitted from portions $\mathbf{20}_1$–$\mathbf{20}_N$ in each region 20 strike corresponding light-emissive element 22 to produce an image dot in a black and white embodiment of the FED, or part of an image dot in a color implementation.

Electron-emissive portions $\mathbf{20}_1$–$\mathbf{20}_N$ in each region 20 may be laterally separated in various ways. At least two of portions $\mathbf{20}_1$–$\mathbf{20}_N$ in each region 20 are normally separated from each other in the column (primary) direction. Plural integer N is typically 2. This example is depicted in FIGS. 11 and 12*a*. Hence, each region 20 in FIGS. 11 and 12*a* consists of portions $\mathbf{20}_1$ and $\mathbf{20}_2$ spaced apart from each other in the column direction.

Backplate structure 10 in the FED of FIGS. 11 and 12 contains an electron-focusing system 40 configured roughly in the shape of a waffle as seen in plan view. System 40 focuses electrons emitted by regions 20 so that a large fraction of the electrons emitted by portions $\mathbf{20}_1$–$\mathbf{20}_N$ in each region 20 strike corresponding target light-emissive element 22. Electron-focusing system 40 has an upper surface that forms part of the interior surface of backplate structure 10.

An array of rows and columns of laterally separated pluralities 42P of focus openings extend vertically through electron-focusing system 40. One focus-opening plurality 42P responds to each different electron-emissive region 20. Each focus-opening plurality 42P occupies a lateral area that fully overlaps corresponding electron-emissive region 20. Accordingly, each spacer wall 14 contacts backplate structure 10 between a pair of rows of focus-opening pluralities 42P, typically along the upper surface of system 40, as viewed generally perpendicular to backplate structure 10.

Each focus-opening plurality 42P consists of N laterally separated focus openings $\mathbf{42P}_1$, $\mathbf{42P}_2$, . . . $\mathbf{42P}_N$ situated respectively above portions $20_1$–$\mathbf{20}_N$ of corresponding electron-emissive region 20. Since at least two of portions $\mathbf{20}_1$–$\mathbf{20}_N$ in each region 20 are laterally separated in the column direction, at least two of focus openings $\mathbf{42P}_1$–$\mathbf{42P}_N$ in each plurality 42P are spaced apart from one another in the column direction. In the typical example illustrated in FIGS. 11 and 12*a*, each focus-opening plurality 42P consists of focus openings $\mathbf{42P}_1$ and $\mathbf{42P}_2$ spaced apart from each other in the column direction and situated respectively above portions $\mathbf{20}_1$ and $\mathbf{20}_2$ of corresponding electron-emissive region 20.

The lateral spacing between focus openings $\mathbf{42P}_1\mathbf{14}$ $\mathbf{42P}_N$ in each plurality 42P typically occurs along the full heights of these focus openings $\mathbf{42P}_1$–$\mathbf{42P}_N$. Openings $\mathbf{42P}_1$–$\mathbf{42P}_N$ in each plurality 42P are thereby laterally disconnected from each other throughout all of electron-focusing system 40. This example is illustrated in FIGS. 12*a* and 12*b*.

Alternatively, focus openings $\mathbf{42P}_1$–$\mathbf{42P}_N$ in each plurality 42P can be laterally disconnected from one another along parts of their heights. For instance, openings $\mathbf{42P}_1$–$\mathbf{42P}_N$ in each plurality 42P can be laterally separated from another at their tops but can be connected together below their tops. That is, openings $\mathbf{42P}_1$–$\mathbf{42P}_N$ in each plurality 42P connect to one another below the upper surface of system 40. Because openings $\mathbf{42P}_1$–$\mathbf{42P}_N$ in each plurality 42P are laterally separated along part of their heights in this alternative, these openings $\mathbf{42P}_1$–$\mathbf{42P}_N$ are separated electrically (or electrostatically) and are considered to be laterally separated physically.

Each focus opening $\mathbf{42P}_i$ of each plurality 42P is normally of greater average lateral area than portion $\mathbf{20}_i$ of corresponding electron-emissive region 20, where i is an integer running from 1 to N. Each electron-emissive portion $\mathbf{20}_i$ is typically approximately centered laterally on its focus opening $\mathbf{42P}_1$ in the row (further) direction. Each portion $\mathbf{20}_i$ may also be approximately centered laterally on its focus opening $\mathbf{42P}_i$ in the column direction. Alternatively, as indicated in the example of FIGS. 11 and 12*a*, the center of each portion $\mathbf{20}_i$ may be somewhat offset laterally from the center of associated opening $\mathbf{42P}_i$. In any event, each focus opening $\mathbf{42P}_i$ laterally surrounds its electron-emissive portion $\mathbf{20}_i$ as viewed generally perpendicular to backplate structure 10.

FIG. 12*a* depicts electron-emissive portions $\mathbf{20}_i$ as being laterally generally in the shape of equal-size rectangles. Focus openings $\mathbf{42P}_i$ are likewise depicted in FIGS. 12*a* as being laterally generally in the shape of larger equal-size rectangles The rectangles for portions $\mathbf{20}_i$ and openings $\mathbf{42P}_i$ are shown ag being longer in the column direction than in the row direction. Alternatively, the rectangles can be longer in the row direction than the column direction. Also, portions $\mathbf{20}_i$ and openings $\mathbf{42P}_i$ can have lateral shapes other than rectangles. Alternative exemplary shapes include circles, ovals, and trapezoids.

During display operation, electrons emitted by portions $\mathbf{20}_1$–$\mathbf{20}_N$ in each activated electron-emissive region 20 respectively pass through focus openings $\mathbf{42P}_1$–$\mathbf{42P}_N$ of corresponding plurality 42P. Electron-focusing system 40 appropriately controls the trajectories of the emitted electrons.

Each portion $\mathbf{20}_i$ of each electron-emissive region 20 emits electrons that strike corresponding light-emissive element 22 with an intensity profile that is roughly bell-shaped or relatively flat. Portions $\mathbf{20}_1$–$\mathbf{20}_N$ in each region 20 are spaced sufficiently far apart from one another that the electron-striking intensities produced by these portions $\mathbf{20}_1$–$\mathbf{20}_N$ reach maximum values at laterally separated points along corresponding element 22. The sum of the electron-striking intensities of portions $\mathbf{20}_1$–$\mathbf{20}_N$ in each region 20 constitute overall electron-striking intensity $I_E$. Due largely to the lateral separation of the peak values of the electron-striking intensities produced by portions $\mathbf{20}_1$–$\mathbf{20}_N$ in each region 20, intensity $I_E$ is more distributed across corresponding light-emissive element 22 than occurs in the baseline FED represented by the profiles of FIGS. 3*a*, 3*b*, 4*a*, and 4*b*. By appropriately choosing plural integer N, and the configuration, shapes, and sizes of portions $20_1$–$\mathbf{20}_N$ in each region 20 along with the shapes and sizes of focus openings $\mathbf{42P}_1$–$\mathbf{42P}_N$ in each plurality 42P, the double-humped intensity profiles of FIGS. 7*a*, 7*b*, 8*a*, and 8*b* can be achieved as well as the flattened intensity profiles of FIGS. 5*a*, 5*b*, 6*a*, and 5*b*.

Referring specifically to the example of FIGS. 11, 12*a*, and 12*b*, electrons emitted by portions $\mathbf{20}_1$ and $\mathbf{20}_2$ of each electron-emissive region 20 strike corresponding light-emissive element 22 with respective intensities that reach peak values at a pair of locations laterally separated in the column (primary) direction. The sum of the electron-striking intensities produced by those portions $\mathbf{20}_1$ and $\mathbf{20}_2$ forms the intensity profiles of FIGS. 7*a*, 7*b*, 8*a*, and 8*b*. As projected onto backplate structure 10 and thus as viewed generally perpendicular to backplate structure 10 (or baseplate structure 12), the local minimum in the $I_E$ profile of FIG. 7*a* for a light-emissive element 22 occurs at a location between portions $\mathbf{20}_1$ and $\mathbf{20}_2$ of corresponding electron-emissive region 20.

Figure 13:
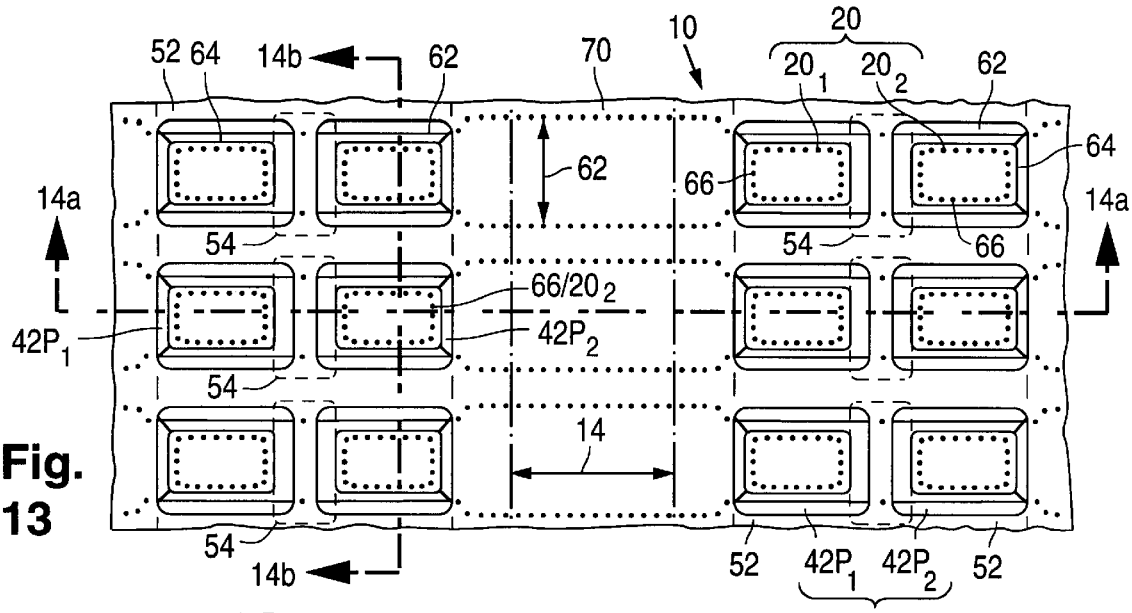
FIG. 13 is a cross-sectional layout view of an implementation, according to the invention, of the portion of the backplate structure in the flat-panel display of FIGS. 11, 12*a*, and 12*b*. The cross section of FIG. 13 is taken through electrically non-conductive material of an electron-focusing system in the display. However, to facilitate illustration, the non-conductive material of the electron-focusing system is unshaded in FIG. 13 rather than being shaded.
Figure 14A:
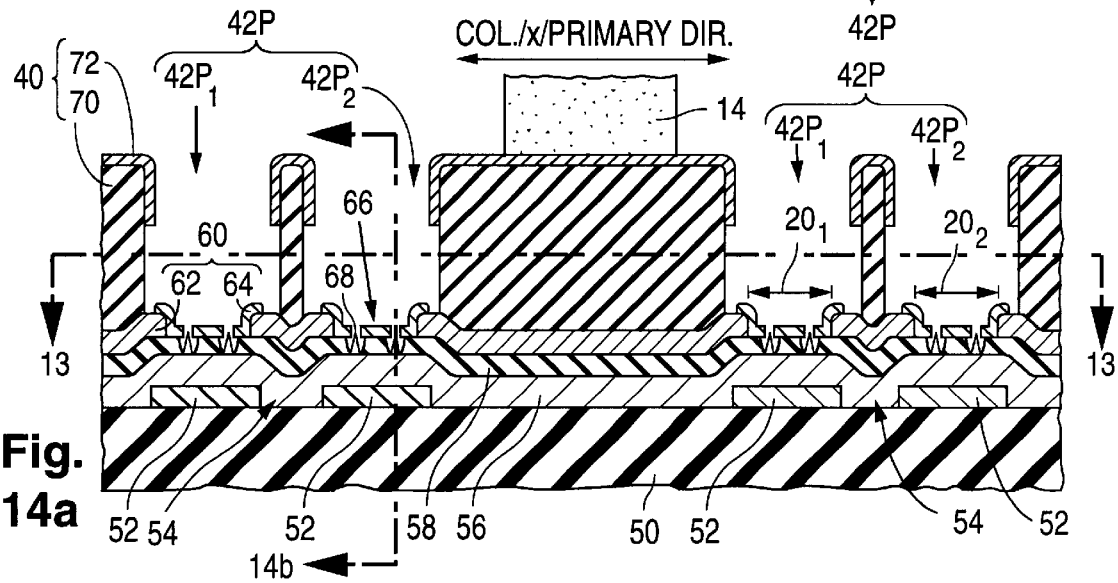
FIGS. 14*a* and 14*b* are cross-sectional side views perpendicular to each other of the implementation of the portion of the backplate structure in the flat-panel display of FIG. 13. The cross section of FIG. 13 is taken through plane 13—13 in FIGS. 14*a* and 14*b*. The cross section of FIG. 14*a* is taken through plane 14*a*— 14*a* in FIGS. 13 and 14*b*. The cross section of FIG. 14*b* is taken through plane 14*b*13 14*b* in FIGS. 13 and 14*a*.
Figure 14B:
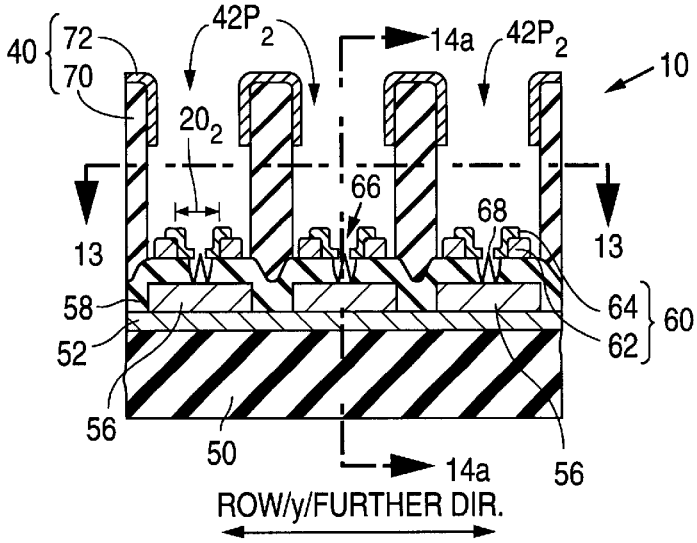

FIG. 13 illustrates a cross-sectional layout of an implementation, in accordance with the invention, of the portion of backplate structure 10 in the FED of FIGS. 11, 12*a*, and 12*b*. The dot-and-dash lines in FIG. 13 indicate the relative location of one spacer wall 14. Side cross sections, taken perpendicular to each other, of the portion of backplate structure 10 in FIG. 13 are depicted in FIGS. 14*a* and 14*b*. Plane 14*a*—14*a* in FIGS. 13 and 14*b* corresponds to plane 11—11 in FIGS. 12*a* and 12*b* and thus to plane 30 in FIG. 2.

Backplate structure 10 in FIGS. 13, 14*a*, and 14*b* is created from a thin flat electrically insulating backplate 50 typically consisting of transparent material. A group of laterally separated, generally parallel metallic emitter electrodes 52 are situated on backplate 10. Emitter electrodes 52 extend generally in the row direction and thus constitute row electrodes. Each emitter electrode 52 lies below a different corresponding row of electron-emissive regions 20. FIGS. 13 and 14*a* depict two electrodes 52. In FIG. 13, the lateral boundaries of each electrode 52 are shown in dashed line.

A group of emitter-electrode openings 54 extend through each emitter electrode 52. Openings 54 in each electrode 52 respectively correspond to overlying electron-emissive regions 20. Each emitter-electrode opening 54 is located laterally between portions $\mathbf{20}_1$ and $\mathbf{20}_2$ of corresponding region 20 as viewed generally perpendicular to backplate structure 10. Openings 54 are utilized in repairing short-circuit defects that may arise between emitter electrodes 52 and overlying control electrodes described further below. Use of openings 54 for short-circuit repair is described in Spindt et al, U.S. patent application Ser. No. 09/071,465, filed Apr. 30, 1998, now U.S. Pat. No. 6,107,728, the contents of which are incorporated by reference herein.

An electrically resistive layer 56 is situated on emitter electrodes 52. Resistive layer 56 is shown in FIGS. 14*a* and 14*b* but, to avoid crowding, does not appear in FIG. 13. Layer 56 extends down to backplate 50 in emitter-electrode openings 54 and in the spaces between electrodes 52. In the example of FIGS. 14*a* and 14*b*, layer 56 is patterned into laterally separated electrically resistive portions that generally underlie the control electrodes. A dielectric layer 58 lies on top of resistive layer 56.

A group of composite laterally separated, generally parallel metallic control electrodes 60 are situated on dielectric layer 58. Control electrodes 60 extend generally in the column direction and thus constitute column electrodes. Electrodes 60 cross over emitter electrodes 52 in a generally perpendicular manner. Each control electrode 60 controls the emission of electrons from one of regions 20 overlying each different emitter electrode 52.

Each control electrode 60 normally consists of a main control portion 62 and a group of adjoining gate portions 64 equal in number to N times the number of emitter electrodes 52, Main control portions 62 extend in the column direction fully across the area from which regions 20 emit electrons. Except where main portions 62 are directly visible in the cross-sectional layout of FIG. 13, the lateral boundaries of main portions 62 are indicated in dotted lines in FIG. 13.

Gate portions 64 are situated in main control openings 66 extending through main control portions 62 directly above emitter electrodes 52. FIGS. 14*a* and 14*b* illustrate gate portions 64 as extending above main portions 62. Alternatively, gate portions 64 can extend below main portions 62. Although gate portions 64 are illustrated as being laterally separated in FIGS. 13, 14*a*, and 14*b*, gate portions 64 that adjoin a main portion 62 can be connected to one another along that main portion 62.

Each portion $\mathbf{20}_i$ of each electron-emissive region 20 here consists of multiple electron-emissive elements 68 situated in openings extending through dielectric layer 58. Electron-emissive elements 68 of each portion $\mathbf{20}_i$ are exposed through gate openings extending through a different corresponding one of gate portions 64. Elements 68 are typically generally conical in shape as illustrated in FIGS. 14*a* and 14*b*. Elements 68 can have other shapes such as filaments, randomly shaped particles, and so on.

The lateral area occupied by electron-emissive elements 68 in portion $\mathbf{20}_i$ of each electron-emissive region 20 is laterally bounded by a different corresponding one of main control openings 66 as viewed generally perpendicular to backplate structure 10. Consequently, elements 68 are allocated into laterally separated sets, each forming an electron-emissive portion $\mathbf{20}_i$ defined laterally by corresponding main control opening 66.

Waffle-shaped electron-focusing system 40 consists of an electrically non-conductive base focusing structure 70 and a thin electrically non-insulating focus coating 72 situated over part of base focusing structure 70. Since focus coating 72 is thin and generally follows the lateral contour of base focusing structure 70, only the layout of structure 70 is illustrated in FIG. 13. Openings extend through structure 70 at the locations of focus openings $\mathbf{42P}_i$. In the example of FIG. 14, focus coating 72 extends only partway down into these openings in structure 70. The remaining portions of these openings then constitute focus openings $\mathbf{42P}_i$.

Base focusing structure 70 normally consists of electrically insulating material but can be formed with electrically resistive material of sufficiently high resistivity as to not cause control electrodes 60 to be electrically coupled to one another. Focus coating 72 normally consists of electrically conductive material, typically metal. In certain applications, focus coating 72 can be formed with electrically resistive material. In any event, focus coating 72 is of lower, typically much lower, average electrical resistivity than structure 70. Alternatively, electron-focusing system 40 can consist of an upper electrically conductive portion and a lower electrically insulating portion.

In the configuration of FIGS. 13, 14*a*, and 14*b*, each focus opening $\mathbf{42P}_i$ laterally surrounds a different corresponding one of main control openings 66 as viewed generally perpendicular to backplate structure 10. Since main control openings 66 laterally define electron-emissive portions $\mathbf{20}_i$, each focus opening $\mathbf{42P}_i$ laterally surrounds corresponding portion $\mathbf{20}_i$ as viewed generally perpendicular to backplate structure 10. Also, part of electron-focusing system 40 overlies emitter-electrode openings 54. The portions of system 40 overlying openings 54 are sufficiently thin laterally in the example of FIGS. 13, 14*a*, and 14*b* that focus openings $\mathbf{42P}_1$ and $\mathbf{42P}_2$ of each focus-opening plurality (pair here) partially overlie the particular emitter-electrode opening 54 situated, in plan view, between portions $\mathbf{20}_1$ and $\mathbf{20}_2$ of corresponding electron-emissive region 20.

A suitable focus-coating potential is applied to focus coating 72 during FED operation. Since focus coating 72 is typically of much lower average electrical resistivity than base focusing structure 70, coating 72 provides the large majority of the electron-focus control. Structure 70 physically supports coating 72.

FIGS. 13, 14*a*, and 14*b* depict the example of electron-focusing system 40 in which focus openings $\mathbf{42P}_i$ of each plurality 42P are laterally disconnected from one another along all of their heights. In the variation where focus openings $\mathbf{42P}_i$ in each plurality 42P are connected together along parts of their heights, the connection is made through focus coating 72 since it provides the large majority of the electron-focus control. The full height of base focus structure 70 is absent in regions between focus openings $\mathbf{42}P_i$ of each plurality 42P in this variation.

Subject to forming each electron-emissive region 20 as portions $\mathbf{20}_1$ and $\mathbf{20}_2$, backplate structure 10 of FIGS. 13, 14*a*, and 14*b* is typically fabricated in w generally the following manner. Emitter electrodes 52 are formed on backplate structure 10, followed by resistive layer 56 and dielectric layer 58. Main control portions 62 are created, followed by gate portions 64. If gate portions 64 are to underlie, rather than overlie, segments of main control portions 62, the last two operations are reversed.

At this point, various operations can be utilized to form electron-emissive elements 68 and electron-focusing system 40. For example, base focusing structure 70 can be created from photopatternable electrically insulating material. Openings can be created in gate portions 64 and dielectric layer 58 according to a charged-particle tracking procedure of the type described in U.S. Pat. Nos. 5,559,389 or 5,564,959. Electron-emissive elements 68 are created generally as cones by depositing electrically conductive material through the openings in gate portions 64 and into the openings in dielectric layer 58. The excess emitter-cone material that accumulates over the structure is removed. Finally, focus coating 72 is formed on base focusing structure 70.

In subsequent operations, backplate structure 10 is assembled through an annular outer wall (not shown) to faceplate structure 12 to form the FED. During the assembly procedure, spacer walls 14 are inserted between plate structures 10 and 12. The assembly procedure is conducted in such a way that the assembled, sealed display is at a very low internal pressure, typically $10^{-7}$ torr or less.

An FED containing backplate structure 10 configured as shown in FIGS. 13, 14*a*, and 14*b* operates in the following way. The anode in faceplate structure 10 is maintained at a high positive potential relative to control electrodes 60 and emitter electrodes 52. A row of electron-emissive regions 20 is selected, normally one row at a time, by placing emitter electrode 52 for that row at a suitable selection potential. Individual regions 20 in each selected row are selected by placing their control electrodes 60 at suitable activation potentials. Each so-selected gate portion 64 extracts electrons from electron-emissive element 68 in portions $\mathbf{20}_1$ and $\mathbf{20}_2$ of corresponding region 20 and controls the magnitude of the resulting electron current.

Directional terms such as "top", "upper", and "lateral" have been employed in describing the present invention to establish a frame of reference by which the reader can more easily understand how the various parts of the invention fit together. In actual practice, the components of the present FED may be situated at orientations different from that implied by the directional items used here. Inasmuch as directional items are used for convenience to facilitate the description, the invention encompasses implementations in which the orientations differ from those strictly covered by the directional terms employed here.

While the invention has been described with reference to particular embodiments, this description is solely for the purpose of illustration and is not to be construed to limiting the scope of the invention claimed below. For instance, the moving average can be done at a selected relatively small percentage other than 10%. A selected percentage in the range from 5% to 20% is typically satisfactory. The moving average of the intensity at a point for a given direction is then the average of the intensity in that direction across (a) a distance of one half the selected percentage of a characteristic dimension e.g., the mean dimension of light-emissive element 22 in the primary (x) direction, before that point and (b) a distance of one half the selected percentage of the characteristic dimension after that point.

The spacer system can have spacers of shapes other than relatively flat walls. Examples include posts and combinations of flat walls. If these other spacer shapes lead to $y_E$ centroid shifting of significant magnitude, the intensity profile of FIG. 6*a* or 8*a* can be replaced with a modified profile similar to that of FIG. 5*a* or 7*a* to alleviate image degradation.

Centroid positions $x_E$, $y_E$, $x_L$, and $y_L$ can be vertically projected back onto backplate structure 10. When so projected, each centroid position $x_E$, $y_E$, $x_L$, or $y_L$ for the zero-shift situation may be located inside or outside corresponding electron-emissive region 20 depending on the shape of that region 20. Individual columns of electron-emissive regions 20 can be selected one column at a time, and selected regions 20 in each selected column can then be activated, rather than vice versa as described above. In this regard, the definitions of rows and columns are arbitrary and can be reversed. For such a reversal, the primary (x) direction is the row direction, and the further (y) direction is the column direction. In general, the primary direction passes through a spacer and a light-emitting element as viewed generally perpendicular to faceplate structure 12. The further direction is perpendicular to the primary direction.

Light-emissive elements 22 can have non-rectangular shapes. Examples of alternative shapes for elements 22 include ovals and oblong octagons. Electrons emitted by portions $\mathbf{20}P_1$–$\mathbf{20}_N$ of each region 20 can pass through respectively corresponding openings of a backplate-structure component other than, or in addition to, electron-focusing system 40.

Field emission includes the phenomenon generally termed surface conduction emission. The field-emission device in the present flat-panel CRT display can be replaced with an electron emitter that operates according to thermionic emission or photoemission. Various modifications and applications may thus be made by those skilled in the art without departing from the true scope and spirit of the invention as defined in the appended claims.

We claim:

1. A flat-panel display comprising:

a first plate structure comprising an electron-emissive region for emitting electrons; and a second plate structure comprising a light-emissive element for emitting light upon being struck by electrons, electrons emitted from the electron-emissive region striking the light-emissive element with an intensity having an electron-striking centroid along the second plate structure for causing the light-emissive element to emit light with an intensity having a light-emitting centroid along the second plate structure, the light-emitting centroid being shifted in a primary direction due to shifting of the electron-striking-centroid in the primary direction, the display having a primary centroid shift ratio $R_P$ defined as (a) the amount of shift of the light-emitting centroid in the primary direction divided by (b) the accompanying amount of shift of the electron-striking centroid in the primary direction, the plate structures including means for causing primary centroid shift ratio $R_P$ to be no more than 0.5 when the magnitude of shift of the electron-striking centroid in the primary direction is in a shift range appropriate to the light-emissive element.

2. A display as in claim 1 wherein the causing means causes primary centroid shift ratio $R_P$ to be no more than 0.35 when the magnitude of shift of the electron-striking centroid in the primary direction is in the shift range.

3. A display as in claim 2 wherein the causing means causes primary centroid shift ratio $R_P$ to be no more than 0.25 when the magnitude of shift of the electron-striking centroid in the primary direction is in the shift range.

4. A display as in claim 1 wherein the causing means causes the intensity of electrons striking the light-emissive element along an imaginary plane extending in the primary direction through the center of the light-emissive element generally perpendicular to the second plate structure to have a 10% moving average intensity profile having a local minimum.

5. A display as in claim 4 wherein the causing means causes the intensity value of the aforementioned local minimum to be no more than 95% of the maximum intensity value of the 10% moving average intensity profile.

6. A display as in claim 4 wherein the causing means causes the intensity value of the aforementioned local minimum to be no more than 90% of the maximum intensity value of the 10% moving average intensity profile.

7. A display as in claim 4 wherein the electron-emissive region comprises a pair of electron-emissive portions laterally separated in the primary direction so as to at least partially implement the causing means.

8. A display as in claim 7 wherein the causing means causes the aforementioned local minimum to occur laterally at a projected location situated between the electron-emissive portions as viewed generally perpendicular to the first plate structure.

9. A display as in claim 1 wherein the shift range extends from zero to an upper value of at least 2% of the mean dimension of the light-emissive element in the primary direction.

10. A display as in claim 9 wherein the upper value of the shift range is at least 5% of the mean dimension of the light-emissive element in the primary direction.

11. A display as in claim 1 further including a spacer situated between the plate structures, the spacer located such that an imaginary plane extending in the primary direction generally perpendicular to either plate structure passes through the spacer and the light-emissive element.

12. A display as in claim 11 wherein the spacer is generally shaped like a wall, the imaginary plane extending generally perpendicular to the wall.

13. A display as in claim 1 wherein the second plate structure includes a border region which laterally surrounds the light-emissive element along the second plate structure and which, compared to the light-emissive element, is largely non-emissive of light upon being struck by electrons emitted from the electron-emissive region.

14. A display as in claim 1 wherein the light-emissive element is of greater mean dimension in the primary direction than perpendicular to the primary direction.

15. A display as in claim 14 wherein the electron-emissive region comprises multiple electron-emissive elements.

16. A flat-panel display comprising:

a first plate structure comprising an electron-emissive region for emitting electrons; and a second plate structure comprising a light-emissive element for emitting light upon being struck by electrons, electrons emitted from the electron-emissive region striking the light-emissive element with an intensity having an electron-striking centroid along the second plate structure for causing the light-emissive element to emit light with an intensity having a light-emitting centroid along the second plate structure, the light-emissive centroid being shifted in a primary direction due to shifting of the electron-striking centroid in the primary direction, the light-emitting centroid also being shiftable in a further direction different from the primary direction, the display having a relative centroid shift ratio $R_P/R_F$ where $R_P$ is (a) the amount of shift of the light-emitting centroid in the primary direction divided by (b) the accompanying amount of shift of the electron-striking centroid in the primary direction, and $R_F$ is (a) the amount that the light-emitting centroid is shiftable in the further direction divided by (b) the accompanying amount that the electron-striking centroid is shiftable in the further direction, the plate structures including means for causing relative centroid shift ratio $R_P/R_F$ to be no more than 0.75 when the magnitudes of shift of the electron-striking centroid in the primary and further directions are respectively in primary and further shift ranges appropriate to the light-emissive element.

17. A display as in claim 16 wherein the causing means causes relative centroid shift ratio $R_P/R_F$ to be no more than 0.5 when the magnitudes of shift of the electron-striking centroid in the primary and further directions are respectively in the primary and further shift ranges.

18. A display as in claim 17 wherein the causing means causes relative centroid shift ratio $R_P/R_F$ to be no more than 0.35 when the magnitudes of shift of the electron-striking centroid in the primary and further directions are respectively in the primary and further shift ranges.

19. A display as in claim 16 wherein the causing means causes the intensity of electrons striking the light-emissive element along an imaginary plane extending in the primary direction through the center of the light-emissive element generally perpendicular to the second plate structure to have a 10% moving average intensity profile having a local minimum.

20. A display as in claim 19 wherein the causing means causes the intensity value of the aforementioned local minimum to be no more than 95% of the maximum intensity value of the 10% moving average intensity profile.

21. A display as in claim 19 wherein the causing means causes the intensity value of the aforementioned local minimum to be no more than 90% of the maximum intensity value of the 10% moving average intensity profile.

22. A display as in claim 19 wherein the electron-emissive region comprises a pair of electron-emissive portions laterally separated in the primary direction so as to at least partially implement the causing means.

23. A display as in claim 22 wherein the causing means causes the aforementioned local minimum to occur laterally at a projected location situated between the electron-emissive portions as viewed generally perpendicular to the first plate structure.

24. A display as in claim 22 wherein each electron-emissive portion comprises multiple electron-emissive elements.

25. A display as in claim 16 wherein the primary shift range extends from zero to an upper value of at least 2% of the mean dimension of the light-emissive element in the primary direction, and the further shift range extends from zero to an upper value of at least 2% of the mean dimension of the light-emissive element in the further direction.

26. A display as in claim 25 wherein the upper value of the primary shift range is at least 5% of the mean dimension of the light-emissive element in the primary direction, and the upper value of the further shift range is at least 10% of the mean dimension of the light-emissive element in the further direction.

27. A display as in claim 16 wherein the further direction is approximately perpendicular to the primary direction.

28. A display as in claim 16 further including a spacer situated between the plate structures, the spacer located such that an imaginary plane extending in the primary direction generally perpendicular to either plate structure passes through the spacer and the light-emissive element.

29. A display as in claim 28 wherein the spacer is generally shaped like a wall, the imaginary plane extending generally perpendicular to the wall.

30. A display as in claim 16 wherein the second plate structure includes a border region which laterally surrounds the light-emissive element along the second plate structure and which, compared to the light-emissive element, is largely non-emissive of light upon being struck by electrons emitted from the electron-emissive region.

31. A display as in claim 16 wherein the intensity of light emitted by the light-emissive element is approximately proportional to the intensity of electrons striking the light-emissive element when the electron-striking intensity is sufficiently below where the light-emissive element undergoes light-emission saturation.

32. A display as in claim 16 wherein, with largely no shifting of the electron-striking centroid in the primary direction, the causing means causing the intensity of electrons striking the light-emissive element to have a standard deviation of no more than 20% of the average intensity of electrons striking the light-emissive element along its centerline in the primary direction.

33. A display as in claim 32 wherein the causing means causes the standard deviation of the electron-striking intensity to be no more than 10% of the average electron-striking intensity along the centerline of the light-emissive element in the primary direction.

34. A display as in claim 15 wherein, with largely no shifting of the electron-striking centroid in the primary direction, the causing means causes electrons emitted by the electron-emissive region to strike material of the second plate structure outside the light-emissive element at an average intensity which, over a specified distance away from the light-emissive element along a line going through the light-emissive element's centerline in the primary direction, is at least 50% of the average intensity of electrons striking the light-emissive element along its centerline in the primary direction, the specified distance being at least 10% of the length of the light-emissive element along its centerline in the primary direction.

35. A display as in claim 16 wherein, with largely no shifting of the electron-striking centroid in the primary direction, the causing means causes the intensity at which electrons emitted by the first plate structure strike material of the second plate structure outside the light-emissive element along a line going through the light-emissive element's centerline in the primary direction to decrease, before reaching a specified distance away from the light-emissive element, to no more than 10% of the average intensity of electrons striking the light-emissive element along its centerline in the primary direction, the specified distance being no more than 80% of the distance along the line going through the light-emissive element's centerline in the primary direction to an immediately adjacent light-emissive element of the second plate structure.

36. A display as in claim 16 wherein the causing means causes $R_P$ to be no more than 0.5 when the magnitude of shift of the electron-striking centroid in the primary direction is in the primary shift range.

37. A display as in claim 36 wherein the causing means causes $R_P$ to be no more than 0.35 when the magnitude of shift of the electron-striking centroid in the primary direction is in the primary shift range.

38. A display as in claim 16 wherein the light-emissive element is of greater mean dimension in the primary direction than in the further direction.

39. A flat-panel display comprising:

a first plate structure comprising a two-dimensional array of electron-emissive regions for emitting electrons; and a second plate structure comprising a like-arranged two-dimensional array of light-emissive elements for emitting light upon being struck by electrons, the light-emissive elements respectively corresponding to the electron-emissive regions, electrons emitted from each electron-emissive region striking the corresponding light-emissive element with an intensity having an electron-striking centroid along the second plate structure for causing that light-emissive element to emit light with an intensity having a light-emitting centroid along the second plate structure, the intensities of electrons striking the light-emissive elements along imaginary planes extending in a primary direction through the centers of the light-emissive elements generally perpendicular to the second plate structure having a composite average intensity profile, the plate structures including means for causing the composite average intensity profile to have a local minimum such that ratio $\overline{R}_P$ of the amount of average shift of the light-emitting centroids in the primary direction to the amount of average attendant shift of the electron-striking-centroids in the primary direction is no more than 0.5 when the magnitude of average shift of the electron-striking centroids in the primary direction is in a shift range appropriate to the light-emissive elements.

40. A display as in claim 39 wherein the causing means causes the intensity value of the aforementioned local minimum to be no more than 95% of the maximum intensity value of the composite average intensity profile.

41. A display as in claim 39 wherein each electron-emissive region comprises a pair of electron-emissive portions laterally separated in the primary direction so as to at least partially implement the causing means.

42. A display as in claim 39 wherein the causing means causes ratio $\overline{R}_P$ to be no more than 0.35 when the magnitude of average shift of the electron-striking centroid in the primary direction is in the shift range.

43. A display as in claim 39 wherein the number of light-emissive elements for determination of the composite average intensity profile is at least ten.

44. A display as in claim 39 wherein the light-emissive elements are largely identical in shape.

45. A display as in claim 39 wherein the shift range extends from zero to an upper value of at least 2% of the average mean dimension of the light-emissive elements in the primary direction.

46. A flat-panel display comprising:

a first plate structure comprising a two-dimensional array of electron-emissive regions for emitting electrons; and a second plate structure comprising a like-arranged two-dimensional array of light-emissive elements for emitting light upon being struck by electrons, the light-emissive elements respectively corresponding to the electron-emissive regions, electrons emitted from each electron-emissive region striking the corresponding light-emissive element with an intensity having an electron-striking centroid along the second plate structure for causing that light-emissive element to emit light with an intensity having a light-emitting centroid along the second plate structure, the light-emitting centroids being shifted in a primary direction due to shifting of the electron-striking centroids in the primary direction, the light-emitting centroids being shiftable in a further direction different from the primary direction, the intensities of electrons striking the light-emissive elements along imaginary planes extending in the primary direction through the centers of the light-emissive elements generally perpendicular to the second plate structure having a composite average intensity profile, the plate structures including means for causing the composite average intensity profile to have a local minimum such that relative centroid shift ratio $\overline{R}_P/\overline{R}_F$ is no more than 0.75 when the magnitudes of average shift of the electron-striking centroids in the primary and further directions are respectively in primary and further shift ranges appropriate to the light-emissive elements, where $\overline{R}_P$ is (a) the amount of the average shift of the light-emitting centroids in the primary direction divided by (b) the accompanying amount of average shift of the electron-striking centroids in the primary direction, and $\overline{R}_F$ is (a) the amount that the light-emitting centroids are averagely shiftable in the further direction divided by (b) the accompanying amount that the electron-striking centroids are averagely shiftable in the further direction.

47. A display as in claim 46 wherein the causing means causes the intensity value of the aforementioned local minimum to be no more than 95% of the maximum intensity value of the composite average intensity profile.

48. A display as in claim 46 wherein each electron-emissive region comprises a pair of electron-emissive portions laterally separated in the primary direction so as to at least partially implement the causing means.

49. A display as in claim 48 wherein each electron-emissive portion comprises multiple electron-emissive elements.

50. A display as in claim 46 wherein the causing means causes relative centroid shift ratio $\overline{R}_P/\overline{R}_F$ to be no more than 0.5 when the magnitudes of average shift of the electron-striking centroids in the primary and further directions are respectively in the primary and further shift ranges.

51. A display as in claim 46 wherein the causing means causes $\overline{R}_P$ to be no more than 0.5 when the magnitude of average shift of the electron-striking centroids in the primary direction is in the primary shift range.

52. A display as in claim 46 wherein the number of light-emissive elements for determination of the composite average intensity profile is at least ten.

53. A display as in claim 46 wherein the light-emissive elements are largely identical in shape.

54. A display as in claim 46 wherein the primary shift range extends from zero to an upper value of at least 2% of the average mean dimension of the light-emissive elements in the primary direction, and the further shift range extends from zero to an upper value of at least 2% of the average mean dimension of the light-emissive elements in the further direction.

55. A flat-panel display for producing an image, the display comprising:

a first plate structure comprising (a) an electron-emissive region having a plurality of laterally separated electron-emissive portions for selectively emitting electrons and (b) an electron-focusing system for focusing electrons emitted by the electron-emissive portions, the electron-focusing system having a like plurality of focus openings located respectively above the electron-emissive portions so that the electrons emitted by the electron-emissive portions pass respectively through the focus openings; and a second plate structure comprising a light-emissive element, situated opposite the electron-emissive region, for emitting light to produce at least part of a dot of the image upon being struck by electrons emitted by the electron-emissive portions.

56. A display as in claim 55 wherein the electron-emissive portions emit electrons substantially simultaneously.

57. A display as in claim 55 wherein each electron-emissive portion comprises multiple electron-emissive elements.

58. A display as in claim 57 wherein each electron-emissive element is at least partially shaped generally like a cone.

59. A display as in claim 55 wherein the first plate structure further includes:

an emitter electrode;

a dielectric layer overlying the emitter electrode and having dielectric openings in which electron-emissive elements of the electron-emissive portions are largely situated; and a control electrode overlying the dielectric layer, crossing over the emitter electrode, and having control openings through which the electron-emissive elements are exposed, the electron-emissive elements being allocated into laterally separated sets, each set forming a different one of the electron-emissive portions.

60. A display as in claim 59 wherein the emitter electrode has at least one emitter-electrode opening located, as viewed generally perpendicular to the first plate structure, between at least two of the electron-emissive portions.

61. A display as in claim 60 wherein each focus opening partially overlies at least one such emitter-electrode opening.

62. A display as in claim 59 wherein the control electrode comprises:

a main portion having a like plurality of main openings, each defining a different corresponding one of the electron-emissive portions; and at least one gate portion contacting the main portion, being thinner than the main portion, spanning the main portion, and having the gate openings, each control opening being a gate opening.

63. A display as in claim 62 wherein, as viewed generally perpendicular to the first plate structure, each focus opening laterally surrounds a different corresponding one of the main openings.

64. A display as in claim 55 wherein the electron-focusing system comprises a base focusing structure and a focus coating overlying the base focusing structure, the focus coating being of lower average electrical resistivity than the base focusing structure, the focus openings extending through the focus coating at laterally separated locations.

65. A display as in claim 55 wherein the focus openings are laterally disconnected from one another throughout substantially all of the electron-focusing system.

66. A display as in claim 55 wherein the electron-focusing system has an upper surface through which the focus openings penetrate at laterally separated locations and, below the upper surface of the electron-focusing system, at least two of the focus openings are connected to one another.

67. A display as in claim 55 further including a spacer situated between the plate structures.

68. A display as in claim 67 wherein the spacer is shaped generally like a wall.

69. A flat-panel display for producing an image, the display comprising:

a first plate structure comprising (a) an array of laterally separated electron-emissive regions, each having a plurality of laterally separated electron-emissive portions for selectively emitting electrons, and (b) an electron-focusing system for focusing electrons emitted by the electron-emissive portions, the electron-focusing system having an array of laterally separated pluralities of focus openings, the focus openings in each focus-opening plurality located respectively above one of the electron-emissive portions of a different corresponding one of the electron-emissive regions so that the electrons emitted by the electron-emissive portions of each electron-emissive region respectively pass through the focus openings of the corresponding focus-opening plurality; and a second plate structure comprising an array of light-emissive elements, each situated opposite a different corresponding one of the electron-emissive regions for emitting light to produce at least part of a different dot of an image upon being struck by electrons emitted from the electron-emissive portions of the corresponding electron-emissive region.

70. A display as in claim 69 wherein the electron-emissive portions of each electron-emissive region emit electrons substantially simultaneously.

71. A display as in claim 69 wherein the first plate structure further includes:

a group of laterally separated emitter electrodes;

a dielectric layer overlying the emitter electrodes and having dielectric openings in which electron-emissive elements of the electron-emissive portions are largely situated; and a group of control electrodes overlying the dielectric layer, crossing over the emitter electrodes; and having control openings through which the electron-emissive elements are exposed, the electron-emissive elements being allocated into laterally separated sets, each set forming a different one of the electron-emissive portions.

72. A display as in claim 71 wherein each emitter electrode has multiple emitter-electrode openings, each associated with one of the electron-emissive regions and located between at least two of the electron-emissive portions of the associated electron-emissive region as viewed generally perpendicular to the first plate structure.

73. A display as in claim 71 wherein the control electrodes extend approximately perpendicular to the emitter electrodes.

74. A display as in claim 69 wherein the electron-focusing system comprises a base focusing structure and a focus coating overlying the base focusing structure, the focus coating being of lower average electrical resistivity than the base focusing structure, the focus openings extending through the focus coating at laterally separated locations.

75. A display as in claim 69 further including at least one spacer situated between the plate structures, contacting the first plate structure laterally between the focus openings as viewed generally perpendicular to the first plate structure, and contacting the second plate structure between the light-emissive elements as viewed generally perpendicular to the second plate structure.

76. A display as in claim 75 wherein each spacer is generally shaped like a wall.

77. A display as in claim 1 wherein the causing means includes an electron-focusing system for focusing electrons emitted by the electron-emissive region.

78. A display as in claim 77 wherein the electron-focusing system has at least one focus opening located above the electron-emissive region so that electrons emitted by the electron-emissive region pass through each focus opening.

79. A display as in claim 7 wherein the causing means includes an electron-focusing system for focusing electrons emitted by the electron-emissive region.

80. A display as in claim 79 wherein the electron-focusing system has a pair of focus openings located respectively above the electron-emissive portions so that electrons emitted by the electron-emissive portions pass respectively through the focus openings.

81. A display as in claim 16 wherein the causing means includes an electron-focusing system for focusing electrons emitted by the electron-emissive region.

82. A display as in claim 81 wherein the electron-focusing system has at least one focus opening located above the electron-emissive region so that electrons emitted by the electron-emissive region pass through each focus opening.

83. A display as in claim 22 wherein the causing means includes an electron-focusing system for focusing electrons emitted by the electron-emissive region.

84. A display as in claim 83 wherein the electron-focusing system has a pair of focus openings located respectively above the electron-emissive portions so that electrons emitted by the electron-emissive portions pass respectively through the focus openings.

85. A display as in claim 39 wherein the causing means includes an electron-focusing system for focusing electrons emitted by the electron-emissive regions.

86. A display as in claim 85 wherein the electron-focusing system has at least one focus opening located above each electron-emissive region so that electrons emitted by each electron-emissive region pass through each overlying focus opening.

87. A display as in claim 41 wherein the causing means includes an electron-focusing system for focusing electrons emitted by the electron-emissive regions.

88. A display as in claim 87 wherein the electron-focusing system has a pair of focus openings located respectively above the electron-emissive portions of each electron-emissive region so that the electrons emitted by each electron-emissive portion pass through the overlying focus opening.

89. A display as in claim 46 wherein the causing means includes an electron-focusing system for focusing electrons emitted by the electron-emissive regions.

90. A display as in claim 89 wherein the electron-focusing system has at least one focus opening located above each electron-emissive region so that electrons emitted by each electron-emissive region pass through each overlying focus opening.

91. A display as in claim 48 wherein the causing means includes an electron-focusing system for focusing electrons emitted by the electron-emissive regions.

92. A display as in claim 91 wherein the electron-focusing system has a pair of focus openings located respectively above the electron-emissive portions of each electron-emissive region so that the electrons emitted by each electron-emissive portion pass through the overlying focus opening.

* * * * *